US006187137B1

(12) United States Patent
Druecke et al.

(10) Patent No.: US 6,187,137 B1
(45) Date of Patent: Feb. 13, 2001

(54) METHOD OF PRODUCING LOW DENSITY RESILIENT WEBS

(75) Inventors: Frank Gerald Druecke, Oshkosh; Shan Liang Chen, Appleton; Michael Alan Hermans, Neenah; Sheng-Hsin Hu, Appleton; Richard Joseph Kamps, Wrightstown, all of WI (US)

(73) Assignee: Kimberly-Clark Worldwide, Inc., Neenah, WI (US)

( * ) Notice: Under 35 U.S.C. 154(b), the term of this patent shall be extended for 0 days.

(21) Appl. No.: 08/961,773

(22) Filed: Oct. 31, 1997

(51) Int. Cl.[7] ..... D21H 27/00

(52) U.S. Cl. ..... 162/109; 162/111; 162/112; 162/113; 162/205; 162/206; 162/207

(58) Field of Search ..... 162/109, 113, 162/116, 111, 117, 112, 205, 206, 207, 281

(56) References Cited

U.S. PATENT DOCUMENTS

| | | | |
|---|---|---|---|
| 1,297,192 | 3/1919 | Le Roy et al. . | |
| 1,718,573 | 6/1929 | Millspaugh . | |
| 2,091,805 | 8/1937 | Chuse | 92/38 |
| 2,861,354 | 11/1958 | Hultgreen | 34/68 |
| 2,926,116 | 2/1960 | Keim | 162/164 |
| 3,052,991 | 9/1962 | Goldner | 34/89 |
| 3,058,873 | 10/1962 | Keim et al. | 162/164 |
| 3,084,448 | 4/1963 | Dungler | 34/155 |
| 3,176,412 | 4/1965 | Gardner | 34/122 |
| 3,208,158 | 9/1965 | Smith, Jr. | 34/122 |
| 3,220,914 | 11/1965 | Boadway et al. | 161/128 |
| 3,224,926 | 12/1965 | Bernardin | 162/146 |
| 3,284,285 | 11/1966 | Holden | 162/297 |
| 3,303,576 | 2/1967 | Sisson | 34/115 |
| 3,319,354 | 5/1967 | Hering, Jr. et al. | 34/155 |
| 3,340,617 | 9/1967 | Carroll, Jr. | 34/18 |
| 3,371,427 | 3/1968 | Thygeson, Sr. | 34/155 |
| 3,447,247 | 6/1969 | Daane | 34/122 |
| 3,455,778 | 7/1969 | Bernardin | 162/113 |
| 3,537,954 | 11/1970 | Justus | 162/305 |
| 3,574,261 | 4/1971 | Bailey | 34/23 |
| 3,577,651 | 5/1971 | Nichols | 34/155 |
| 3,587,177 | 6/1971 | Overly et al. | 34/156 |
| 3,599,341 | 8/1971 | Darcy et al. | 34/23 |
| 3,607,624 | 9/1971 | Moody et al. | 162/272 |
| 3,617,442 | 11/1971 | Hurschman | 162/212 |
| 3,629,056 | 12/1971 | Forrest | 162/305 |
| 3,729,376 | 4/1973 | Stevens | 162/306 |
| 3,771,236 | 11/1973 | Candor et al. | 34/16 |
| 3,771,239 | 11/1973 | Minoda et al. | 34/156 |
| 3,810,818 | 5/1974 | Arledter | 162/301 |

(List continued on next page.)

FOREIGN PATENT DOCUMENTS

| | | | |
|---|---|---|---|
| 677083 | 12/1963 | (CA) . | |
| 0 033 559 A2 | 8/1981 | (EP) | D21F/11/00 |
| 0 328 227 A2 | 8/1989 | (EP) . | |

(List continued on next page.)

OTHER PUBLICATIONS

Bieman, Leonard H., Kevin G. Harding, and Albert Boehnlein, "Absolute Measurement Using Field Shifted Moiré," *Optics, Illumination, and Image Sensing for Machine Vision VI*, SPIE Proceedings Series, Nov. 14–15, 1991, vol. 1614, pp. 259–264.

(List continued on next page.)

*Primary Examiner*—Peter Chin
(74) *Attorney, Agent, or Firm*—Thomas M. Gage; Patricia A. Charlier

(57) ABSTRACT

A method of using a conventional wet-pressed creped tissue machine produces a textured tissue sheet that is dried on a conventional cylindrical drum dryer to create an uncreped product with throughdried-like properties. Machine modifications and a proper balance of adhesive compounds and release agents permit a textured sheet to be dried on a Yankee drier and then pulled off without use of a crepe blade.

41 Claims, 4 Drawing Sheets

U.S. PATENT DOCUMENTS

| | | | |
|---|---|---|---|
| 3,812,598 | 5/1974 | Lefebvre et al. | 34/155 |
| 3,822,182 | 7/1974 | Heyse et al. | 162/207 |
| 3,844,881 | 10/1974 | Moody | 162/297 |
| 3,849,904 | 11/1974 | Villalobos | 34/155 |
| 3,895,449 | 7/1975 | Chance et al. | 34/155 |
| 3,913,241 | 10/1975 | Chaikin et al. | 34/122 |
| 3,923,593 | 12/1975 | Verseput | 162/301 |
| 3,930,319 | 1/1976 | Coleman | 34/122 |
| 4,072,557 | 2/1978 | Schiel | 162/111 |
| 4,074,441 | 2/1978 | Helversen et al. | 34/122 |
| 4,120,747 | 10/1978 | Sarge, III et al. | 162/117 |
| 4,121,968 | 10/1978 | Wells | 162/290 |
| 4,125,430 | 11/1978 | Grossman | 162/207 |
| 4,157,938 | 6/1979 | Clemens et al. | 162/207 |
| 4,163,688 | 8/1979 | Kankaanpaa | 162/359 |
| 4,183,147 | 1/1980 | Kawaguchi | 34/16 |
| 4,197,973 | 4/1980 | Daane | 226/97 |
| 4,201,323 | 5/1980 | Stibbe et al. | 226/97 |
| 4,309,246 | 1/1982 | Hulit et al. | 162/113 |
| 4,345,385 | 8/1982 | Sando et al. | 34/23 |
| 4,361,466 | 11/1982 | Wong et al. | 162/207 |
| 4,364,185 | 12/1982 | Dussourd et al. | 34/122 |
| 4,421,600 | 12/1983 | Hostetler | 162/111 |
| 4,440,597 | 4/1984 | Wells et al. | 162/111 |
| 4,462,868 | 7/1984 | Oubridge et al. | 162/280 |
| 4,528,316 | 7/1985 | Soerens | 524/503 |
| 4,529,480 | 7/1985 | Trokhan | 162/109 |
| 4,541,895 | 9/1985 | Albert | 162/348 |
| 4,551,199 | 11/1985 | Weldon | 162/109 |
| 4,556,450 | 12/1985 | Chuang et al. | 162/204 |
| 4,571,359 | 2/1986 | Dutt | 428/240 |
| 4,637,859 | 1/1987 | Trokhan | 162/109 |
| 4,787,641 | 11/1988 | Rautakorpi et al. | 277/135 |
| 4,835,880 | 6/1989 | Vecchia | 34/115 |
| 4,849,054 | 7/1989 | Klowak | 162/109 |
| 4,871,425 | 10/1989 | Gunderson | 162/290 |
| 4,888,096 | 12/1989 | Cowan et al. | 162/358 |
| 4,892,622 | 1/1990 | Malkki et al. | 162/208 |
| 4,915,788 | 4/1990 | Winheim | 162/207 |
| 4,953,297 | 9/1990 | Eskelinen et al. | 34/23 |
| 4,976,821 | 12/1990 | Laapotti | 162/360.1 |
| 4,986,009 | 1/1991 | Haessner et al. | 34/23 |
| 5,043,046 | 8/1991 | Laapotti | 162/358 |
| 5,048,589 | 9/1991 | Cook et al. | 162/109 |
| 5,070,627 | 12/1991 | Zagar | 34/156 |
| 5,070,628 | 12/1991 | Zagar | 34/156 |
| 5,085,737 | 2/1992 | Brogyanyi et al. | 162/359 |
| 5,105,562 | 4/1992 | Hella et al. | 34/156 |
| 5,129,988 | 7/1992 | Farrington, Jr. | 162/123 |
| 5,137,600 | 8/1992 | Barnes et al. | 162/115 |
| 5,149,401 | 9/1992 | Langevin et al. | 162/207 |
| 5,187,219 | 2/1993 | Furman, Jr. | 524/377 |
| 5,225,042 | 7/1993 | Eaton et al. | 162/203 |
| 5,230,776 | 7/1993 | Andersson et al. | 162/290 |
| 5,274,930 | 1/1994 | Ensign et al. | 34/23 |
| 5,336,373 | 8/1994 | Scattolino et al. | 162/116 |
| 5,348,620 | 9/1994 | Hermans et al. | 162/9 |
| 5,381,580 | 1/1995 | Kotitschke et al. | 15/302 |
| 5,411,636 | 5/1995 | Hermans et al. | 162/109 |
| 5,429,686 | 7/1995 | Chiu et al. | 139/383 A |
| 5,471,765 | 12/1995 | Rautakorpi et al. | 34/242 |
| 5,490,903 | 2/1996 | Chen et al. | 162/111 |
| 5,501,768 | 3/1996 | Hermans et al. | 162/9 |
| 5,508,095 | 4/1996 | Allum et al. | 428/242 |
| 5,556,053 | 9/1996 | Henseler | 242/541.6 |
| 5,598,643 | 2/1997 | Chuang et al. | 34/406 |
| 5,601,871 | 2/1997 | Krzysik et al. | 427/288 |
| 5,607,551 | 3/1997 | Farrington, Jr. et al. | 162/109 |
| 5,611,893 | 3/1997 | Pajula et al. | 162/360.2 |
| 5,620,566 | 4/1997 | Holopainen | 162/205 |
| 5,625,961 | 5/1997 | Ensign et al. | 34/117 |
| 5,656,132 | 8/1997 | Farrington, Jr. et al. | 162/117 |
| 5,667,636 | 9/1997 | Engel et al. | 162/117 |
| 5,746,887 | 5/1998 | Wendt et al. | 162/109 |
| 5,772,845 | 6/1998 | Farrington, Jr. et al. | 162/109 |

FOREIGN PATENT DOCUMENTS

| | | | |
|---|---|---|---|
| 0 502 602 A1 | 9/1992 | (EP) . | |
| 0 574 366 A1 | 12/1993 | (EP) | D21F/11/14 |
| 0 616 074 A1 | 9/1994 | (EP) | D21F/11/00 |
| 679 469 | 4/1930 | (FR) . | |
| 679469 | 4/1930 | (FR) . | |
| 1235868 | 5/1960 | (FR) . | |
| 2 303 116 | 10/1976 | (FR) | D21H/5/12 |
| 1057373 | 2/1967 | (GB) . | |
| 2 152 961 | 8/1985 | (GB) | B31F/1/12 |
| 2 179 949 | 3/1987 | (GB) | C08L/31/04 |
| 2 179 953 | 3/1987 | (GB) | C09J/3/00 |
| 2 235 754 | 3/1991 | (GB) | F26B/13/12 |
| 2 254 288 | 10/1992 | (GB) | B32B/3/24 |
| WO 90/04676 A1 | 5/1990 | (WO) | D21F/9/00 |
| WO 91/16493 A1 | 10/1991 | (WO) | D21F/9/00 |
| WO 93/23616 A1 | 11/1993 | (WO) | D21F/11/14 |
| WO 95/00706 A1 | 1/1995 | (WO) | D21H/27/30 |
| WO 97/43483 A1 | 11/1997 | (WO) | D21F/11/00 |
| WO 97/43484 A1 | 11/1997 | (WO) | D21F/11/00 |
| WO 99/23300 A1 | 5/1999 | (WO) . | |

OTHER PUBLICATIONS

Bowden, Edward V., "Non–Contact Drying and Turning—the 'On Machine' Technology of the Nineties," *Appita*, vol. 44, No. 1, Jan. 1991, pp. 41–46.

Haberl, Andrew et al., "First Linerboard Application Of The Gas Heated Paper Dryer," *45th Appita Annual General Conference Proceedings*, vol. 1, 1991, pp. 47–50.

Kufferath, W. et al., "Die Sonic–Roll," *Das Papier*, 42(10A): V140, 1988.

Lindsay, Jeffrey D. and Leonard H. Bieman, "Exploring Tactile Properties of Tissue With Moire Interferometry," *Non–Contact, Three–Dimensional Gaging Methods and Technologies Workshop*, Dearborn, Michigan, Mar. 1997.

Lindsay, Jeffrey D., "Displacement Dewatering To Maintain Bulk," *Paperi Ja Puu—Paper And Timber*, vol. 74, No. 3, 1992, pp. 232–242.

Mummery, Leigh, *Surface Texture Analysis: The Handbook*, published by Hommelwerke GmbH, Muhlhausen, Germany, 1990, pp. 37–45.

Page, R.H. and J. Seyed–Yagoobi, "A New Concept For Air Or Vapor Impingement Drying," *Tappi Journal*, 73(9), Sep. 1990, pp. 229–234.

TAPPI Official Test Method T 494 om–88, "Tensile Breaking Properties Of Paper And Paperboard (Using Constant Rate Of Elongation Apparatus)," published by the TAPPI Press, Atlanta, Georgia, revised 1988, pp. 1–5.

TAPPI Useful Method UM 256, "Water Retention Value (WRV)," published by the TAPPI Press, Atlanta, Georgia, pp. 54–56.

Thiele, P.E. and R.H. Page, "Enhancement Of Drying Rate, Moisture Profiling And Sheet Stability On An Existing Paper Machine With RJR Blow Boxes," *1995 Papermakers Conference*, Tappi Press, Atlanta, Georgia, 1995, pp. 223–228.

Bieman, Leonard H., Kevin G. Hardin, and Albert Boehnlein, "Absolute Measurement Using Field Shifted Moiré," *Optics, Illumination, and Image Sensing for Machine Vision VI*, SPIE Proceedings Series, Nov. 14–15, 1991, Vol. 1614, pp.259–264.

Bowden, Edward V., "Non–Contact Drying and Turning — the 'On Machine' Technology of the Nineties, "*Appita*, Vol. 44, No. 1, January 1991, pp. 41–46.

Haberl, Andrew et al., "First Linerboard Application Of The Gas Heated Papaer Dryer," *45th Appita Annual General Conference Proceedings*, Vol. 1, 1991, pp. 47–50.

Kufferath, W. et al., "Die Sonic–Roll," *Das Papier*, 42(10A): V140, 1988.

Lindsay, Jeffrey D. and Leonard H. Bieman, "Exploring Tactile Properties of Tissue With Moire Interferometry," *Non–Contact, Three–Dimensional Gaging Methods and Technologies Workshop*, Dearborn, Michigan, March 1997.

Lindsay, Jeffrey D., "Displacement Dewatering To Maintain Bulk," *Paperi Ja Puu–Paper And Timber*, Vol. 74, No. 3, 1992, pp. 232–242.

Mummery, Leigh, *Surface Texture Analysis: The Handbook*, published by Hommelwerke GmbH, Muhlhausen, Germany, 1990, pp. 37–45.

Page, R.H. and J. Seyed–Yagoobi, "A New Concept For Air Or Vapor Impingement Drying," *Tappi Journal*, 73(9), September 1990, pp. 229–234.

TAPPI Official Test Method T 494 om–88, "Tensile Breaking Properties Of Paper And Paperboard (Using Constant Rate Of Elongation Apparatus)," published by the TAPPI Press, Atlanta, Georgia, revised 1988, pp. 1–5.

TAPPI Useful Method UM 256, "Water Retention Value (WRV)," published by the TAPPI Press, Atlanta, Georgia, pp. 54–56.

Thiele, P.E. and R.H. Page, "Enhancement Of Drying Rate, Moisture Profiling And Sheet Stability On An Existing Paper Machine With RJR Blow Boxes," *1995 Papermakers Conference*, Tappi Press, Atlanta, Georgia, 1995, pp. 223–228.

METHOD OF PRODUCING LOW DENSITY RESILIENT WEBS

BACKGROUND OF THE INVENTION

The present invention relates generally to methods for making tissue products. More particularly, the invention concerns methods for making an uncreped tissue on a modified conventional wet-pressing machine.

In the art of tissue making, large steam-filled cylinders known as Yankee dryers are commonly used to dry a tissue web that is pressed onto the dryer cylinder surface while the tissue web is still wet. In conventional tissue making, the wet paper web is firmly pressed against the surface of the Yankee dryer. The compression of the wet web against the drum provides intimate contact for rapid heat transfer into the web. As the web dries, adhesive bonds form between the surface of the Yankee dryer and the tissue web, often promoted by sprayed-on adhesive applied before the point of contact between the wet web and the dryer surface. The adhesive bonds are broken when the flat, dry web is scraped off the dryer surface by a creping blade, which imparts a fine, soft texture to the web, increases bulk, and breaks many fiber bonds for improved softness and reduced stiffness.

Traditional creping suffers from several drawbacks. Because the sheet is pressed flat against the Yankee, the hydrogen bonds that develop as the web dries are formed between the fibers in a flat, dense state. Although creping imparts many kinks and deformations in the fibers and adds bulk, when the creped sheet is wetted, the kinks and deformations relax as the fibers swell. As a result, the web tends to return to the flat state set when the hydrogen bonds were formed. Thus, a creped sheet tends to collapse in thickness and expand laterally in the machine direction upon wetting, often becoming wrinkled in the process if some parts of the laterally expanding web are restrained, still dry, or held against another surface by surface tension forces.

Further, creping limits the texture and bulk that can be imparted to the web. Relatively little can be done with the conventional operation of Yankees to produce a highly textured web such as the throughdried webs that are produced on textured throughdrying fabrics. The flat, dense structure of the web upon the Yankee sharply limits what can be achieved in terms of the subsequent structure of the product coming off the Yankee.

Another drawback of traditional creping is that the doctor blades used to effect creping on papermaking machines are subject to wear due to contact with the surface of the rotating cylinder. As wear progresses, the effectiveness of the doctor blade is diminished, which leads to progressively more variability in the tissue properties. Creping blades are commonly replaced after a product property of particular importance, such as stretch, bulk, or machine direction tensile strength, has changed from predetermined target levels. Changing creping blades requires considerable down-time and slows production.

The foregoing drawbacks of traditional creping may be avoided by producing an uncreped throughdried tissue web. Such webs may be produced with a bulky three-dimensional structure rather than being flat and dense, thereby providing good wet resiliency. It is known, however, that uncreped tissue often tends to be stiff and lacks the softness of creped products. Additionally, throughdried webs sometimes suffer from pinholes in the web due to the flow of air through the web to achieve full dryness. Moreover, most of the world's paper machines use conventional Yankee dryers and tissue manufacturers are reluctant to accept the high cost of adding throughdrying technology or the higher operating costs associated with throughdrying.

Prior attempts to make an uncreped sheet on a drum dryer or Yankee have included wrapping the sheet around the dryer. For example, cylinder dryers have long been used for heavier grades of paper. In conventional cylinder drying, the paper web is carried by dryer fabrics which wrap the cylinder dryer to provide good contact and prevent sheet flutter. Unfortunately, such wrapping configurations are not practical for converting a modern creped tissue machine into an uncreped tissue machine. Typical creped tissue machines employ a Yankee dryer with a heated hood in which high velocity, high temperature air is used to dry the web at rates well above those possible with conventional cylinder dryers. Most dryer fabrics would deteriorate rapidly under the high temperatures of a dryer hood, and they would interfere with heat transfer to the web. Further, the design of a conventional Yankee hood does not allow an endless loop of fabric to wrap the web through the dryer hood, without prohibitively expensive modifications to the equipment.

Therefore, there is a need for a method for making an uncreped tissue having a three-dimensional structure and offering good wet resilience, high softness and flexibility using a conventional papermaking machine including a Yankee dryer and drying hood. More particularly, there is a need for an adhesion control system which adequately adheres the web to the dryer surface to promote conductive heat transfer and resist blowing forces, while being bound loosely enough to allow the web to be pulled off the dryer surface in uncreped mode without damage to the web.

SUMMARY OF THE INVENTION

In response to the needs described above, it has been discovered that a soft, high bulk, textured, wet resilient tissue web can be produced using a conventional Yankee dryer or cylinder dryers in place of large and expensive throughdryers in the production of wet-laid tissue. Indeed, existing wet-pressed creped tissue machines can be economically modified to produce high quality uncreped tissue with properties similar to throughdried materials. High-speed production of such a web with excellent runnability is made possible through an adhesion control system that is adapted to restrain the sheet on the Yankee during drying while still permitting removal after the sheet has been dried. The adhesion control system comprises an interfacial control mixture that can extend the upper limit of the speed of operation of the tissue machine without sheet failure. The interfacial control mixture is especially useful when the tissue sheet is dewatered to a consistency of at least 30 percent prior to the Yankee.

More specifically, the wet web is provided with a three-dimensional high bulk structure before being attached to the cylindrical dryer surface. This is desirably achieved through a combination of using specially treated fibers, such as curled or dispersed papermaking fibers, rush transferring the moist web from a faster to a slower moving fabric, and/or molding the web onto a structured, textured fabric. The three-dimensional structure is characterized by having a substantially uniform density because the sheet is molded on a three-dimensional substrate rather than creating regions of high and low density through compressive means. The three dimensionality of the structure is promoted by noncompressively dewatering the web before attachment to the Yankee.

Thereafter, the web is desirably attached to the Yankee or other heated dryer surface in a manner that preserves a substantial portion of the texture imparted by previous treatments, especially the texture imparted by molding on three-dimensional fabrics. In particular, the web is attached to the dryer surface using a foraminous fabric that promotes good contact while preserving a degree of texture. Such a fabric preferably has low fabric coarseness and is relatively free of isolated protrusions. The conventional manner used to produce wet-pressed creped paper is inadequate for preserving a three-dimensional structure, for in that method, a pressure roll is used to dewater the web and to uniformly press the web into a dense, flat state. For the present invention, the conventional substantially smooth press felt is replaced with a textured material such as a foraminous fabric and desirably a throughdrying fabric, a textured felt, a textured nonwoven or the like.

For best results, significantly lower pressing pressures can be used as compared to conventional tissue making. Desirably, the zone of maximum load applied to the web should be about 400 psi or less, particularly about 150 psi or less, such as between about 2 and about 50 psi, and most particularly about 30 psi or less, when averaged across any one-inch square region encompassing the point of maximum pressure. The pressing pressures measured in pounds per lineal inch (pli) at the point of maximum pressure are desirably about 400 pli or less, and particularly about 350 pli or less. Low-pressure application of a three-dimensional web structure onto a cylindrical dryer helps to maintain substantially uniform density in the dried web.

Since the foraminous fabric is unable to dewater the wet web during pressing as effectively as a felt, additional dewatering means are needed prior to the Yankee dryer to achieve solids levels immediately after the sheet is attached on the Yankee surface of about 30 percent or greater, particularly about 35 percent or greater, such as between about 35 and about 50 percent, and more particularly about 38 percent or greater. Operation at lower solids levels may be possible, but may require undesired slowing of the papermachine to achieve target dryness after the Yankee.

A variety of useful techniques for dewatering the embryonic web, desirably prior to rush transfer, are known in the art. Dewatering at fiber consistencies less than about 30 percent is desirably substantially nonthermal. Nonthermal dewatering means include drainage through the forming fabric induced by gravity, hydrodynamic forces, centrifugal force, vacuum or applied gas pressure, or the like. Partial dewatering by nonthermal means may include those achieved through the use of foils and vacuum boxes on a Fourdrinier or in a twin-wire type former or top-wire modified Fourdrinier, vibrating rolls or "shaker" rolls, including the "sonic roll" described by W. Kufferath et al. in *Das Papier,* 42(10A): V140 (1988), couch rolls, suction rolls, or other devices known in the art. Differential gas pressure or applied capillary pressure across the web may also be used to drive liquid water from the web, as provided by the air presses disclosed in U.S. patent application Ser. No. 08/647,508 filed May 14, 1996, by M. A. Hermans et al. titled "Method and Apparatus for Making Soft Tissue" and U.S. patent application Ser. No. unknown filed on the same day as the present application by F. Hada et al. titled "Air Press For Dewatering A Wet Web"; the paper machine disclosed in U.S. Pat. No. 5,230,776 issued Jul. 27, 1993 to I. A. Andersson et al.; the capillary dewatering techniques disclosed in U.S. Pat. No. 5,598,643 issued Feb. 4, 1997 and U.S. Pat. No. 4,556,450 issued Dec. 3, 1985, both to S. C. Chuang et al.; and the dewatering concepts disclosed by J. D. Lindsay in "Displacement Dewatering to Maintain Bulk," *Paperi ja Puu,* 74(3): 232–242 (1992); which are all incorporated herein by reference. The air press is especially preferred because it can be added economically as a relatively simple machine rebuild and offers high efficiency and good dewatering.

After initial formation of the web in the formation section of a paper machine, such as on a Fourdrinier, the wet web is typically given high machine direction stretch through rush transfer of the wet web from a first carrier fabric onto a first transfer fabric. Use of a coarse, three-dimensional rush transfer fabric allows web molding to occur to provide a resilient, three-dimensional structure with high cross-machine direction stretch. Multiple rush transfer operations may be used to obtain synergistic benefits between fabrics of varying topography and design, and to build desired mechanical properties in the web.

The step of rush transfer can be performed with many of the methods known in the art, particularly for example as disclosed in U.S. patent application Ser. No. 08/790,980 filed Jan. 29, 1997 by Lindsay et al. and titled "Method For Improved Rush Transfer To Produce High Bulk Without Macrofolds"; U.S. patent application Ser. No. 08/709,427 filed Sep. 6, 1996 by Lindsay et al. and titled "Process For Producing High-Bulk Tissue Webs Using Nonwoven Substrates"; U.S. Pat. No. 5,667,636 issued Sep. 16, 1997 to S. A. Engel et al.; and U.S. Pat. No. 5,607,551 issued Mar. 4, 1997 to T. E. Farrington, Jr. et al.; which are incorporated herein by reference. For good sheet properties, the first transfer fabric may have a fabric coarseness (hereinafter defined) of about 30 percent or greater, particularly from about 30 to about 300 percent, more particularly from about 70 to about 110 percent, of the strand diameter of the highest warp or chute of the fabric, or, in the case of nonwoven fabrics, of the characteristic width of the highest elongated structure on the surface of fabric. Typically, strand diameters can range from about 0.005 to about 0.05 inch, particularly from about 0.005 to about 0.035 inch, and more specifically from about 0.010 to about 0.020 inch.

For acceptable heat transfer on the dryer surface, the web may be transferred from the first transfer fabric to a second transfer fabric, desirably having a lower coarseness than the first transfer fabric. The ratio of the second transfer fabric coarseness to the first transfer fabric coarseness is desirably about 0.9 or less, particularly about 0.8 or less, more particularly between about 0.3 and about 0.7, and still more particularly between about 0.2 and about 0.6. Likewise, the surface depth of the second transfer fabric should desirably be less than the surface depth of the first transfer fabric, such that the ratio of surface depth in the second transfer fabric to surface depth of the second transfer fabric is about 0.95 or less, more particularly about 0.85 or less, more particularly between about 0.3 and about 0.75, and still more particularly between about 0.15 and about 0.65.

While woven fabrics are most popular for their low cost and runnability, nonwoven materials are available and under development as replacements for conventional forming fabrics and press felts, and may be used in the present invention. Examples include U.S. patent application Ser. No. 08/709,427 filed Sep. 6, 1996, by J. Lindsay et al. titled "Process for Producing High-bulk Tissue Webs Using Nonwoven Substrates." The interfacial control mixture is adapted to adhere the textured web to the cylindrical dryer to a sufficient degree to promote conductive heat transfer and desirably to withstand high velocity air currents, and yet to release the textured web from the cylindrical dryer surface without creping. As used herein, the term "interfacial control mixture" means a combination of adhesive compounds, release agents and optional other compounds that are disposed at the interface between the wet web and the surface of the cylindrical dryer. The adhesive compounds and release agents of the interfacial control mixture may be applied individually to the fibers or web or first mixed together and applied to the fibers or web, provided that both the adhesive compounds and the release agents are present at the interface between the web and the dryer surface. The adhesive compounds and release agents may be applied to the surface of the cylindrical dryer before attachment of the web; may be applied directly or indirectly to the fibers or web prior to or during attachment of the web to the drying cylinder; or may be applied in the wet end with the fiber slurry. For example, the components may be applied to the dryer surface using either a single spray system or multiple spray systems, such as a spray for adhesive compounds and a spray for release agents.

Suitable adhesive compounds comprise polyvinyl acetate, polyvinyl alcohol, starches, animal glues, high molecular weight polymeric retention aids, cellulose derivatives, ethylene/vinylacetate copolymers, or other compounds known in the art as effective creping adhesives. The adhesive compounds may be mixed with or may comprise aqueous solutions of thermosetting cationic polyamide resin, and desirably further comprise polyvinyl alcohol. Suitable thermosetting cationic polyamide resins are the water-soluble polymeric reaction product of an epihalohydrin, desirably epichlorohydrin, and a water-soluble polyamide having secondary amine groups derived from polyalkylene polyamine and a saturated aliphatic dibasic carboxylic acid containing from about 3 to 10 carbon atoms. A useful but not essential characteristic of these resins is that they are phase compatible with polyvinyl alcohol. Suitable commercial adhesive compounds include KYMENE, available from Hercules, Inc., Wilmington, Del. and CASCAMID, available from Borden of U.S.A., and are more fully described in U.S. Pat. No. 2,926,116 issued Feb. 23, 1960 to G. Keim; U.S. Pat. No. 3,058,873 issued Oct. 16, 1962 to G. Keim et al.; and U.S. Pat. No. 4,528,316 issued Jul. 9, 1985 to D. Soerens; all of which are incorporated herein by reference.

Unlike conventional wet-pressed creping operations, the present invention can be achieved without the need for crosslinking adhesive agents, such as KYMENE, that are normally required for building and maintaining an effective coating of the Yankee dryer surface. The coating needs to be water resistant, otherwise it may be dissolved and damaged by the water from the web in a conventional wet-pressing operation. Water soluble adhesive compounds such as sorbitol and polyvinyl alcohol without added crosslinking agents can be used on the surface of the Yankee dryer in the production of creped through-air dried tissue, for the tissue pressed onto the Yankee dryer surface is already dry enough (typically at a consistency above 60 percent) to eliminate the risk of dissolving the coating and interfering with adequate adhesion. Surprisingly, it has been discovered that entirely water soluble adhesive compounds can be used on the cylindrical dryer surface in the present invention without jeopardizing adequate adhesion even when the web is wet, with consistencies below either 60 percent, 50 percent, 45 percent, or 40 percent, when pressed onto the cylindrical dryer surface. For example, it has been discovered that a mixture of sorbitol and polyvinyl alcohol, with no crosslinking agents present, can serve as an excellent adhesive compound in the present invention, capable of providing stable and adequate adhesion of a wet web onto a Yankee dryer surface while permitting uncreped removal of the web when coupled with an effective amount of release agent. Other water soluble adhesive compounds of potential value in the present invention include starches, animal glues, cellulose derivatives, and the like.

The adhesive compound is desirably applied as a solution containing from about 0.1 to about 10 percent solids, more particularly containing from about 0.5 to about 5 percent solids, the balance typically being water. The adhesive compounds (including wet strength compounds) can comprise from about 10 to 99 weight percent of the active solids in the interfacial control mixture, particularly from about 10 to about 70 weight percent of the active solids in the interfacial control mixture, and more particularly from about 30 to about 60 weight percent of the active solids in the interfacial control mixture.

When using the formulated adhesive compounds described above, the adhesive is desirably added at a rate that would range, on an active adhesive components basis, from about 0.01 to about 30 pounds per ton of dry fiber used in the tissue paper. More particularly, the adhesive add on rate is equal to about 0.01 to about 5 pounds actives adhesive per ton dry fiber, such as about 0.05 to about 1 pound actives adhesive per ton dry fiber, and still more particularly about 0.5 to about 1 pound actives adhesive per ton dry cellulose fiber.

The release agents are added in effective amounts to allow the tissue web to be pulled free from the cylindrical dryer surface without creping and without significant damage to the tissue web. The term "release agent" as used in this application means any chemical or compound that tends to reduce the degree of adhesion of the web to the surface of the drying cylinder provided by the adhesive compounds. The release agents may do so by modifying bulk chemical properties of a mixture, by modifying adhesive interactions preferentially at a surface, by reacting with the adhesive compounds to form compounds of lower adhesive strength, and so forth.

Suitable release agents include plasticizers and tack modifying agents such as quaternized polyamino amides, chemical debonders and surfactants such as TRITON X100 sold by Union Carbide; water soluble polyols such as glycerine, ethylene glycol, diethyleyne glycol, and triethyleyne glycol; silicone release agents including polysiloxanes and related compounds, particularly in relatively small quantities; defoaming agents such as Nalco 131DR sold by Nalco Chemical, desirably added through wet-end addition; hydrophobic or nonpolar compounds such as hydrocarbon oil, mineral oil, vegetable oil, or any combination of this type of hydrocarbon material which is emulsified in the aqueous medium using typical emulsifiers for the purpose; polyglycols such as polyethylene glycols, used by themselves or in combination with the hydrocarbon oils, mineral oils, and vegetable oils, and particularly these release agents may be formulated in water by emulsifying them in water either in the presence or absence of polyethylene glycols and using any combinations of the above hydrocarbon type oils; or the like. When quaternized polyamino amides such as Quaker 2008 sold by Quaker Chemical Company are used, a significant amount relative to other types of release agents may be necessary in order to prevent the tissue sheet from wrapping around the dryer. Routine experimentation will be necessary to determine the optimum amount of water soluble polyols to be used in conjunction with the adhesive compound and other compounds because not all of the water soluble polyols produce similar results. Release agents that are not readily soluble in water are often formulated in water by incorporation of an emulsifier. Other examples of suitable release agents are disclosed in U.S. Pat. No. 5,490,903 issued Feb. 13, 1996 to Chen et al. and U.S. Pat. No. 5,187,219, issued Feb. 16, 1993 to Furman, Jr.; which are incorporated herein by reference.

Suitable amounts of release agent in the interfacial control mixture can be from about 1 to about 90 weight percent, specifically from about 10 to about 90 percent, more specifically from about 15 to about 80 weight percent, and more specifically still from about 25 to about 70 weight percent on a solids basis. The release agent may be added at a rate of about 0.1 to about 10 pounds per ton of dry fiber used, such as about 1 to about 5 pounds per ton of dry fiber used.

The present invention allows a high-bulk tissue web to be dried on a Yankee dryer without the need for a previous throughdrying operation and allows the sheet to be removed without creping to produce an uncreped sheet with throughdried-like properties. Hence in one respect, the invention resides in a method for producing an uncreped tissue web comprising the steps of: a) depositing an aqueous suspension of papermaking fibers onto a forming fabric to form an embryonic web; b) dewatering the web to a consistency of about 30 percent or greater; c) texturing the web against a three-dimensional substrate; d) transferring the web to the surface of a cylindrical dryer; e) applying an interfacial control mixture comprising adhesive compounds and release agents, the interfacial control mixture adapted to adhere the web to the dryer surface without fluttering and permit web detachment without significant web damage; f) drying the web on the cylindrical dryer; and g)detaching the web from the dryer surface without creping.

In another embodiment, a method for producing an uncreped tissue web comprises the steps of: a) depositing an aqueous suspension of papermaking fibers onto a forming fabric to form an embryonic web; b) dewatering the web to a consistency of about 30 percent or greater; c) texturing the web against a three-dimensional textured substrate; d) transferring the web to the surface of a cylindrical dryer at a consistency of about 30 to about 45 percent using a textured substrate; e) applying an interfacial control mixture comprising adhesive compounds and release agents, the adhesive compounds being water soluble and substantially free of crosslinking adhesive agents, the interfacial control mixture adapted to adhere the web to the dryer surface without fluttering and permit web detachment without significant web damage; f) drying the web on the cylindrical dryer; and g) detaching the web from the dryer surface without creping.

In yet another embodiment, a method for producing an uncreped tissue web comprises the steps of: a) depositing an aqueous suspension of papermaking fibers onto a forming fabric to form an embryonic web; b) dewatering the web; c) texturing the web against a three-dimensional textured substrate; d) transferring the web to the surface of a cylindrical dryer; e) applying an interfacial control mixture comprising adhesive compounds and release agents, the interfacial control mixture adapted to adhere the web to the dryer surface without fluttering; f) drying the web on the cylindrical dryer; g) detaching the web from the dryer surface using a creping blade; h) adjusting the interfacial control mixture such that the interfacial control mixture is adapted to adhere the web to the dryer surface without fluttering and permit web detachment without significant web damage; and i) detaching the web from the dryer surface without creping.

In still another embodiment, the invention resides in a method of economically modifying a wet-pressed creped tissue machine for production of textured, uncreped tissue. The machine initially comprises a forming section which includes an endless loop of a forming fabric, an endless loop of a smooth wet-press felt, a transfer section for transporting a wet web of tissue from the forming fabric to the wet-press felt, a Yankee dryer, a press for pressing the wet web residing on the wet-press felt onto the Yankee dryer, a spray section for applying creping adhesive to the surface of the Yankee dryer, a doctor blade adapted to be urged against the Yankee dryer for creping the web from the dryer surface, and a reel, but the wet-pressed creped tissue machine lacks a rotary throughdryer prior to the Yankee dryer.

The method of modifying the machine comprises: a) replacing the smooth wet-press felt with a textured papermaking fabric; b) modifying the transfer section to transfer an embryonic web on the forming fabric to the textured papermaking fabric; c) providing noncompressive dewatering means; d) providing a delivery system for applying a release agent to the surface of the textured papermaking fabric, the release agent adapted to assist release of the web from the papermaking fabric; and e) modifying the spray section to provide effective amounts of components of an interfacial control mixture comprising adhesive compounds and release agents, the interfacial control mixture adapted to permit uncreped operation of the tissue machine such that the tissue web produced on the machine maintains stable attachment to the Yankee until it is pulled off without creping by tension from the reel.

In another respect, the invention resides in a tissue sheet economically produced without throughdrying yet having properties similar to a throughdried sheet. In particular, the invention resides in an uncreped tissue produced on a wet-pressed tissue machine and dried on a cylindrical dryer without rotary throughdrying. The tissue has a three-dimensional topography, substantially uniform density, a bulk of at least 10 cc/g in the uncalendered state and an absorbency of at least 12 grams water per gram fiber. The tissue also comprises detectable amounts of an interfacial control mixture comprising adhesive compounds and release agents. Detection can be done by solvent extraction coupled with FT-IR, mass spectroscopy, or other analytical methods known in the art.

The combination of noncompressive dewatering, low pressure application of the web on the cylinder dryer surface, and the use of a properly selected fabric or felt for applying the web onto the cylinder dryer such that the web is not highly densified by protrusions on the fabric or felt can result in a dried web of substantially uniform density on a macro scale. There may be fabric knuckles which preferentially hold portions of the sheet against the dryer surface, although desirably the sheet would not be substantially densified in those knuckle regions because of adequate noncompressive dewatering prior to drying and by virtue of relatively low pressure applied by the fabric.

Whether the web has substantially uniform density or regions of high and low density, the average bulk (inverse of density) of the web based on measurement of web thickness between flat platens at a load of 0.05 psi can be about 3 cc/g or greater, particularly about 6 cc/g or greater, more particularly about 10 cc/g or greater, more particularly still about 12 cc/g or greater, and most particularly about 15 cc/g or greater. High-bulk webs are often calendered to form a final product. After optional calendering of the web, the bulk of the finished product is desirably about 4 cc/g or greater, more particularly about 6 cc/g or greater, more particularly still about 7.5 cc/g or greater, and most particularly about 9 cc/g or greater.

Many fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or crosslinked fibers) or synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. Mixtures of any subset of the above mentioned or related fiber classes may be used. The fibers can be prepared in a multiplicity of ways known to be advantageous in the art. Useful methods of preparing fibers include dispersion to impart curl and improved drying properties, such as disclosed in U.S. Pat. No. 5,348,620 issued Sep. 20, 1994 and U.S. Pat. No. 5,501,768 issued Mar. 26, 1996, both to M. A. Hermans et al.

Chemical additives may be also be used and may be added to the original fibers, to the fibrous slurry or added on the web during or after production. Such additives include opacifiers, pigments, wet strength agents, dry strength agents, softeners, emollients, humectants, viricides, bactericides, buffers, waxes, fluoropolymers, odor control materials and deodorants, zeolites, dyes, fluorescent dyes or whiteners, perfumes, debonders, vegetable and mineral oils, humectants, sizing agents, superabsorbents, surfactants, moisturizers, UV blockers, antibiotic agents, lotions, fungicides, preservatives, aloe-vera extract, vitamin E, or the like. The application of chemical additives need not be uniform, but may vary in location and from side to side in the tissue. Hydrophobic material deposited on a portion of the surface of the web may be used to enhance properties of the web.

Without the limitations imposed by creping, the chemistry of the uncreped sheet can be varied to achieve novel effects. With creping, for example, high levels of debonders or sheet softeners may interfere with adhesion on the Yankee, but in the uncreped mode, much higher add on levels can be achieved. Emollients, lotions, moisturizers, skin wellness agents, silicone compounds such as polysiloxanes, and the like can now be added at desirably high levels with fewer constraints imposed by creping. In practice, however, care must be applied to achieve proper release from the second transfer fabric and to maintain some minimum level of adhesion on the dryer surface for effective drying and control of flutter. Nevertheless, without relying on creping, there will be much greater freedom in the use of new wet end chemistries and other chemical treatments under the present invention compared to creping methods.

A single headbox or a plurality of headboxes may be used. The headbox or headboxes may be stratified to permit production of a multilayered structure from a single headbox jet in the formation of a web. In particular embodiments, the web is produced with a stratified or layered headbox to preferentially deposit shorter fibers on one side of the web for improved softness, with relatively longer fibers on the other side of the web or in an interior layer of a web having three or more layers. The web is desirably formed on an endless loop of foraminous forming fabric which permits drainage of the liquid and partial dewatering of the web. Multiple embryonic webs from multiple headboxes may be couched or mechanically or chemically joined in the moist state to create a single web having multiple layers.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DEFINITION OF TERMS AND PROCEDURES

Figure 1:
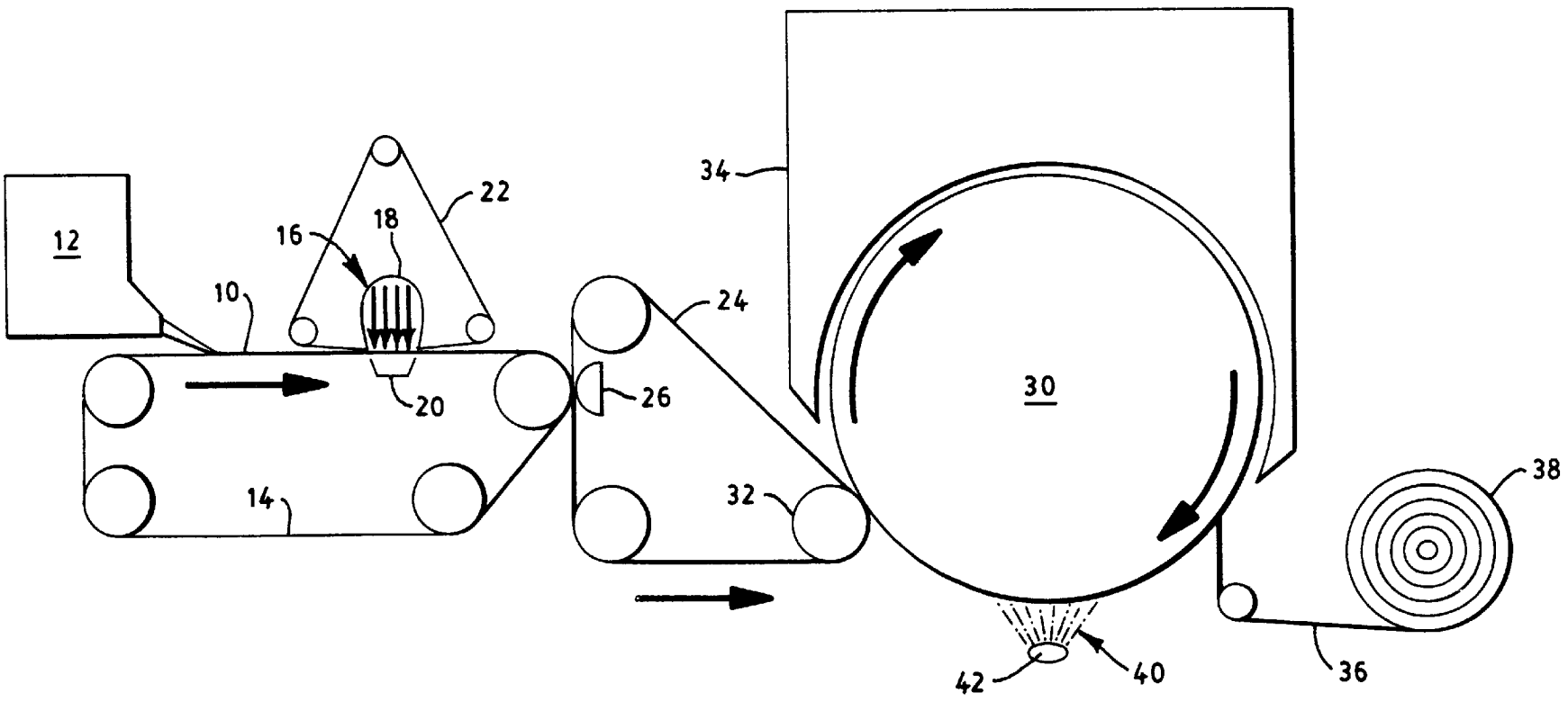
FIG. 1 depicts a schematic process flow diagram illustrating one embodiment of modified wet-pressed crepe machine useful for producing tissue according to the present invention.

As used herein, "MD tensile strength" of a tissue sample is the conventional measure, known to those skilled in the art, of load per unit width at the point of failure when a tissue web is stressed in the machine direction. Likewise, "CD tensile strength" is the analogous measure taken in the cross-machine direction. MD and CD tensile strength are measured using an Instron tensile tester using a 3-inch jaw width, a jaw span of 4 inches, and a crosshead speed of 10 inches per minute. Prior to testing the sample is maintained under TAPPI conditions (73° F., 50% relative humidity) for 4 hours before testing. Tensile strength is reported in units of grams per inch (at the failure point, the Instron reading in grams is divided by 3 since the test width is 3 inches).

"MD stretch" and "CD stretch" refer to the percent elongation of the sample during tensile testing prior to failure. Tissue produced according to the present invention can have a MD stretch about 3 percent or greater, such as from about 4 to about 24 percent, about 5 percent or greater, about 8 percent or greater, about 10 percent or greater and more particularly about 12 percent or greater. The CD stretch of the webs of the present invention is imparted primarily by the molding of a wet web onto a highly contoured fabric. The CD stretch can be about 4 percent or greater, about 6 percent or greater, about 8 percent or greater, about 9 percent or greater, about 11 percent or greater, or from about 6 to about 15 percent.

As used herein, "high-speed operation" or "industrially useful speed" for a tissue machine refers to a machine speed at least as great as any one of the following values or ranges, in feet per minute: 1,000; 1,500; 2,000; 2,500; 3,000; 3,500; 4,000; 4,500; 5,000, 5,500; 6,000; 6,500; 7,000; 8,000; 9,000; 10,000, and a range having an upper and a lower limit of any of the above listed values.

As used herein, "industrially valuable dryness levels" can be about 60 percent or greater, about 70 percent or greater, about 80 percent or greater, about 90 percent or greater, between about 60 and about 95 percent, or between about 75 and about 95 percent. For the present invention, the web should be dried on the cylinder dryer to industrially valuable dryness levels.

As used herein, the "Absorbent Capacity" is determined by cutting 20 sheets of product to be tested into squares measuring 4 inches by 4 inches and stapling the corners together to form a 20 sheet pad. The pad is placed into a wire mesh basket with the staple points down and lowered into a water bath (30° C.). When the pad is completely wetted, it is removed and allowed to drain for 30 seconds while in the wire basket. The weight of the water remaining in the pad after 30 seconds is the amount absorbed. This value is divided by the weight of the pad to determine the Absorbent Capacity, which for purposes herein is expressed as grams of water absorbed per gram of fiber.

The "Absorbent Rate" is determined by the same procedure as the Absorbent Capacity, except the size of the pad is 2.5 inches by 2.5 inches. The time taken for the pad to completely wet out after being lowered into the water bath is the Absorbent Rate, expressed in seconds. Higher numbers mean that the rate at which the water is absorbed is slower.

As used herein, a material is "water soluble" if at least 95 percent of a 1 gram portion of the material can be completely dissolved in 100 ml of deionized water at 95° C. The adhesive compound to be used in the interfacial control mixture is desirably soluble enough that a thin coating of the adhesive compound in aqueous solution having a dry solids mass of 1 gram can be dried and heated at 150° C. for 30 minutes and still be at least 95 percent water soluble in 100 ml of deionized water at 100° C.

As used herein, "Surface Depth" refers to the characteristic peak-to-valley height difference of a textured three-dimensional surface. It can refer to the characteristic depth or height of a molded tissue structure. An especially suitable method for measurement of Surface Depth is moiré interferometry, which permits accurate measurement without deformation of the surface. For reference to the materials of the present invention, surface topography should be measured using a computer-controlled white-light field-shifted moiré interferometer with about a 38 mm field of view. The principles of a useful implementation of such a system are described in Bieman et al., "Absolute Measurement Using Field-Shifted Moiré," SPIE Optical Conference Proceedings, Vol. 1614, pp. 259–264, 1991. A suitable commercial instrument for moiré interferometry is the CADEYES® interferometer produced by Medar, Inc. (Farmington Hills, Mich.), constructed for a 38-mm field-of-view (a field of view within the range of 37 to 39.5 mm is adequate). The CADEYES® system uses white light which is projected through a grid to project fine black lines onto the sample surface. The surface is viewed through a similar grid, creating moiré fringes that are viewed by a CCD camera. Suitable lenses and a stepper motor adjust the optical configuration for field shifting (a technique described below). A video processor sends captured fringe images to a PC computer for processing, allowing details of surface height to be back-calculated from the fringe patterns viewed by the video camera. Principles of using the CADEYES system for analysis of characteristic tissue peak-to-valley height are given by J. D. Lindsay and L. Bieman, "Exploring Tactile Properties of Tissue with Moiré Interferometry," *Proceedings of the Non-contact, Three-dimensional Gaging Methods and Technologies Workshop*, Society of Manufacturing Engineers, Dearborn, Mich., Mar. 4–5, 1997.

The height map of the CADEYES topographical data can then be used by those skilled in the art to identify characteristic unit cell structures (in the case of structures created by fabric patterns; these are typically parallelograms arranged like tiles to cover a larger two-dimensional area) and to measure the typical peak to valley depth of such structures or other arbitrary surfaces. A simple method of doing this is to extract two-dimensional height profiles from lines drawn on the topographical height map which pass through the highest and lowest areas of the unit cells or through a sufficient number of representative portions of a periodic surfaces. These height profiles can then be analyzed for the peak to valley distance, if the profiles are taken from a sheet or portion of the sheet that was lying relatively flat when measured. To eliminate the effect of occasional optical noise and possible outliers, the highest 10 percent and the lowest 10 percent of the profile should be excluded, and the height range of the remaining points is taken as the surface depth. Technically, the procedure requires calculating the variable which we term "P10," defined as the height difference between the 10% and 90% material lines, with the concept of material lines being well known in the art, as explained by L. Mummery, in *Surface Texture Analysis: The Handbook*, Hommelwerke GmbH, Mühlhausen, Germany, 1990. In this approach, the surface is viewed as a transition from air to material. For a given profile, taken from a flat-lying sheet, the greatest height at which the surface begins—the height of the highest peak—is the elevation of the "0% reference line" or the "0% material line," meaning that 0 percent of the length of the horizontal line at that height is occupied by material. Along the horizontal line passing through the lowest point of the profile, 100 percent of the line is occupied by material, making that line the "100% material line." In between the 0% and 100% material lines (between the maximum and minimum points of the profile), the fraction of horizontal line length occupied by material will increase monotonically as the line elevation is decreased. The material ratio curve gives the relationship between material fraction along a horizontal line passing through the profile and the height of the line. The material ratio curve is also the cumulative height distribution of a profile. (A more accurate term might be "material fraction curve.") Once the material ratio curve is established, one can use it to define a characteristic peak height of the profile. The P10 "typical peak-to-valley height" parameter is defined as the difference between the heights of the 10% material line and the 90% material line. This parameter is relatively robust in that outliers or unusual excursions from the typical profile structure have little influence on the P10 height. The units of P10 are mm. The Surface Depth of a material is reported as the P10 surface depth value for profile lines encompassing the height extremes of the typical unit cell of that surface. "Fine surface depth" is the P10 value for a profile taken along a plateau region of the surface which is relatively uniform in height relative to profiles encompassing a maxima and minima of the unit cells. Measurements are reported for the most textured side of the materials of the present invention if two-sidedness is present.

Surface Depth is intended to examine the topography produced in the basesheet, especially those features created in the sheet prior to and during drying processes, but is intended to exclude "artificially" created large-scale topography from dry converting operations such as embossing, perforating, pleating, etc. Therefore, the profiles examined should be taken from unembossed regions if the sheet has been embossed, or should be measured on an unembossed sheet. Surface Depth measurements should exclude large-scale structures such as pleats or folds which do not reflect the three-dimensional nature of the original basesheet itself. It is recognized that sheet topography may be reduced by calendering and other operations which affect the entire basesheet. Surface Depth measurement can be appropriately performed on a calendered sheet.

As used herein, "lateral length scale" refers to a characteristic dimension of a textured three-dimensional web having a texture comprising a repeating unit cell. The minimum width of a convex polygon circumscribing the unit cell is taken as the lateral length scale. For example, in a tissue throughdried on a fabric having repeating rectangular depressions spaced about 1 mm apart in the cross direction and about 2 mm apart in the machine direction, the lateral length scale would be about 1 mm. The textured fabrics (transfer fabrics and felts) described in this invention can have periodic structures displaying a lateral length scale of at least any of the following values: about 0.5 mm, about 1 mm, about 2 mm, about 3 mm, about 5 mm, and about 7 mm.

As used herein, "MD unit cell length" refers to the machine-direction extent (span) of a characteristic unit cell in a fabric or tissue sheet characterized by having a repeating structure. The textured fabrics (transfer fabrics and felts) described in this invention can have periodic structures displaying a lateral length scale of at least any of the following values: about 1 mm, about 2 mm, about 5 mm, about 6 mm, and about 9 mm.

As used herein, "fabric coarseness" refers to the characteristic maximum vertical distance spanned by the upper surfaces of a textured fabric which can come into contact with a paper web deposited thereon.

In one embodiment of the present invention, one or both of the transfer fabrics are made according to the teachings of U.S. Pat. No. 5,429,686 issued Jul. 4, 1995 to K. F. Chiu et al., which is incorporated herein by reference. The three-dimensional fabric disclosed therein has a load-bearing layer adjacent the machine-face of the fabric, and has a three-dimensional sculpture layer on the pulp face of the fabric. The junction between the load-bearing layer and the sculpture layer is called the "sublevel plane". The sublevel plane is defined by the tops of the lowest CD knuckles in the load-bearing layer. The sculpture on the pulp face of the fabric is effective to produce a reverse image impression on the pulp web carried by the fabric.

The highest points of the sculpture layer define a top plane. The top portion of the sculpture layer is formed by segments of "impression" warps formed into MD impression knuckles whose tops define the top plane of the sculpture layer. The rest of the sculpture layer is above the sublevel plane. The tops of the highest CD knuckles define an intermediate plane which may coincide with the sublevel plane, but more often it is slightly above the sublevel plane. The intermediate plane must be below the top plane by a finite distance which is called "the plane difference." The "plane difference" of the fabrics disclosed by Chiu et al. or of similar fabrics can be taken as the "fabric coarseness." For other fabrics, the fabric coarseness can generally be taken as the difference in vertical height between the most elevated portion of the fabric and the lowest surface of the fabric likely to contact a paper web.

A specific measure related to fabric coarseness is the "Putty Coarseness Factor," wherein the vertical height range of a putty impression of the fabric is measured. Dow Corning® Dilatant Compound 3179, which has been sold commercially under the trademark SILLY PUTTY, is brought to a temperature of 73° F. and molded into a disk 2.5 inches in diameter and ½ inch in thickness. The disk is placed on one end of a brass cylinder with a mass of 2046 grams and measuring 2.5 inches in diameter and 3 inches tall. The fabric to be measured is placed on a clean, solid surface, and the cylinder with the putty on one end is inverted and placed gently on the fabric. The weight of the cylinder presses the putty against the fabric. The weight remains on the putty disk for a period of 20 seconds, at which time the cylinder is lifted gently and smoothly, typically bringing the putty with it. The textured putty surface that was in contact with the fabric can now be measured by optical means to obtain estimates of the characteristic maximum peak to valley height difference. A useful means for such measurement is the CADEYES moiré interferometer, described above, with a 38-mm field of view. The measurement should be made within 2 minutes of removing the brass cylinder.

As used herein, the term "textured" or "three-dimensional" as applied to the surface of a fabric, felt, or uncalendered paper web, indicates that the surface is not substantially smooth and coplanar. In particular, it denotes that the surface has a Surface Depth, fabric coarseness, or Putty Coarseness value of at least 0.1 mm, such as between about 0.2 and about 0.8 mm, particularly at least 0.3 mm, such as between about 0.3 and 1.5 mm, more particularly at least 0.5 mm, and still more particularly at least 0.7 mm.

The "warp density" is defined as the total number of warps per inch of fabric width, times the diameter of the warp strands in inches, times 100.

We use the terms "warp" and "shute" to refer to the yarns of the fabric as woven on a loom where the warp extends in the direction of travel of the fabric through the paper making apparatus (the machine direction) and the shutes extend across the width of the machine (the cross-machine direction). Those skilled in the art will recognize that it is possible to fabricate the fabric so that the warp strands extend in the cross-machine direction and the weft strands extend in the machine direction. Such fabrics may be used in accordance with the present invention by considering the weft strands as MD warps and the warp strands as CD shutes.

The warp end shute yarns may be round, flat, or ribbon-like, or a combination of these shapes.

As used herein, "noncompressive dewaterinq" and "non-compressive drying" refer to dewatering or drying methods, respectively, for removing water from cellulosic webs that do not involve compressive nips or other steps causing significant densification or compression of a portion of the web during the drying or dewatering process. Such methods include throughdrying; air jet impingement drying; radial jet reattachment and radial slot reattachment drying, such as described by R. H. Page and J. Seyed-Yagoobi, *Tappi J., 73*(9): 229 (Sep. 1990); non-contacting drying such as air flotation drying, as taught by E. V. Bowden, E. V., *Appita J.,* 44(1): 41 (1991); through-flow or impingement of superheated steam; microwave drying and other radiofrequency or dielectric drying methods; water extraction by supercritical fluids; water extraction by nonaqueous, low surface tension fluids; infrared drying; drying by contact with a film of molten metal; and other methods. It is believed that the three-dimensional sheets of the present invention could be dried or dewatered with any of the above mentioned non-compressive drying means without causing significant web densification or a significant loss of their three-dimensional structure and their wet resiliency properties. Standard dry creping technology is viewed as a compressive drying method since the web must be mechanically pressed onto part of the drying surface, causing significant densification of the regions pressed onto the heated Yankee cylinder.

"Wet compressive resiliency" of a material is a measure of its ability to maintain elastic and bulk properties in the moist state after compression in the z-direction. A programmable strength measurement device is used in compression mode to impart a specified series of compression cycles to a sample that is carefully moistened in a specified manner.

The test sequence begins with compression of the moistened sample to 0.025 psi to obtain an initial thickness (cycle A), then two repetitions of loading up to 2 psi followed by unloading (cycles B and C). Finally, the sample is again compressed to 0.025 psi to obtain a final thickness (cycle D). (Details of the procedure, including compression speeds, are given below). Moisture is applied uniformly to the sample using a fine mist of deionized water to bring the moisture ratio (g water/g dry fiber) to approximately 1.1, though values in the range of 0.9 to 1.6 are acceptable. This is done by applying about 100 percent added moisture, based on the conditioned sample mass. This puts typical cellulosic materials in a moisture range where physical properties are relatively insensitive to moisture content (e.g., the sensitivity is much less than it is for moisture ratios less than 70 percent). The moistened sample is then placed in the test device and the compression cycles are repeated.

Three measures of wet resiliency are considered which are relatively insensitive to the number of sample layers used in the stack. The first measure is the bulk of the wet sample at 2 psi. This is referred to as the "Wet Compressed Bulk" (WCB). The second measure is termed "Springback," which is the ratio of the moist sample thickness at 0.025 psi at the end of the compression test (cycle D) to the thickness of the moist sample at 0.025 psi measured at the beginning of the test (cycle A). The third measure is the "Loading Energy Ratio" (LER), which is the ratio of loading energy in the second compression to 2 psi (cycle C) to that of the first compression to 2 psi (cycle B) during the sequence described above, for a wetted sample. The loading energy is the area under the curve on a plot of applied load versus thickness for a sample going from no load to the peak load of 2 psi; loading energy has units of in-lbf. If a material collapses after compression and loses its bulk, a subsequent compression will require much less energy, resulting in a low LER. For a purely elastic material, the springback and LER would be unity. The three measures described here are relatively independent of the number of layers in the stack and serve as useful measures of wet resiliency. For a purely elastic material, the springback would also be unity. Also referred to herein is the "Compression Ratio," which is defined as the ratio of moistened sample thickness at peak load in the first compression cycle to 2 psi to the initial moistened thickness at 0.025 psi.

In carrying out the foregoing measurements of the wet compressive resiliency, samples should be conditioned for at least 24 hours under TAPPI conditions (50% RH, 73° F.). Samples are cut from the tissue web to yield squares 2.5 inches wide. Typically three to five layers of the web are stacked to produce a 2.5-inch square stack. The mass of the cut square stack is measured with a precision of 10 milligrams or better. Cut sample mass desirably should be near 0.5 g, and should be between 0.4 and 0.6 g; if not, the number of sheets in the stack should be adjusted (3 or 4 sheets per stack has proven adequate in most tests with typical tissue basis weights; wet resiliency results are generally relatively insensitive to the number of layers in the stack).

Moisture is applied uniformly with a fine spray of deionized water at 70–73° F. This can be achieved using a conventional plastic spray bottle, with a container or other barrier blocking most of the spray, allowing only about the outer 20 percent of the spray envelope—a fine mist—to approach the sample. If done properly, no wet spots from large droplets will appear on the sample during spraying, but the sample will become uniformly moistened. The spray source should remain at least 6 in away from the sample during spray application.

A flat porous support is used to hold the samples during spraying while preventing the formation of large water droplets on the supporting surface that could be imbibed into sample edges, giving wet spots. A substantially dry cellulosic foam sponge was used in the present work, but other materials such as a reticulated open cell foam could also suffice.

For a stack of three sheets, the three sheets should be separated and placed adjacent to each other on the porous support. The mist should be applied uniformly, spraying successively from two or more directions, to the separated sheets using a fixed number of sprays (pumping the spray bottle a fixed number of times), the number being determined by trial and error to obtain a targeted moisture level. The samples are quickly turned over and sprayed again with a fixed number of sprays to reduce z-direction moisture gradients in the sheets. The stack is reassembled in the original order and with the original relative orientations of the sheets. The reassembled stack is quickly weighed with a precision of at least 10 milligrams and is then centered on the lower Instron compression platen, after which the computer is used to initiate the Instron test sequence. No more than 60 seconds should elapse between the first contact of spray with the sample and the initiation of the test sequence, with 45 seconds being typical.

When four sheets per stack are needed to be in the target range, the sheets tend to be thinner than in the case of three sheet stacks and pose increased handling problems when moist. Rather than handling each of four sheets separately during moistening, the stack is split into two piles of two sheets each and the piles are placed side-by-side on the porous substrate. Spray is applied, as described above, to moisten the tops sheets of the piles. The two piles are then turned over and approximately the same amount of moisture is applied again. Although each sheet will only be moistened from one side in this process, the possibility of z-direction moisture gradients in each sheet is partially mitigated by the generally decreased thickness of the sheets in four-sheet stacks compared to three sheet stacks. Larger numbers of sheets per stack can be handled in a similar manner. (Limited tests with stacks of three and four sheets from the same tissue showed no significant differences, indicating that z-direction moisture gradients in the sheets, if present, are not likely to be a significant factor in compressive wet resiliency measurement.) After moisture application, the stacks are reassembled, weighed, and placed in the Instron device for testing, as previously described for the case of three-sheet stacks.

Compression measurements are performed using an Instron 4502 Universal Testing Machine interfaced with a 286 PC computer running Instron Series XII software (1989 issue) and Version 2 firmware. The standard "286 computer" referred to has an 80286 processor with a 12 MHz clock speed. The particular computer used was a Compaq DeskPro 286e with an 80287 math coprocessor and a VGA video adapter and an IEEE board for data acquisition and computer control. A 1 kN load cell is used with 2.25 inch diameter circular platens for sample compression. The lower platen has a ball bearing assembly to allow exact alignment of the platens. The lower platen is locked in place while under load (30–100 lbf) by the upper platen to ensure parallel surfaces. The upper platen must also be locked in place with the standard ring nut to eliminate play in the upper platen as load is applied. The load cell should be zeroed in the free hanging state. The Instron and the load cell should be allowed to warm up for one hour before measurements are conducted.

Following at least one hour of warm-up after start-up, the instrument control panel is used to set the extensionometer to zero distance while the platens are in contact (at a load of 10–30 lb), thus ensuring that the extension or thickness reading is the distance between the two platens. The unloaded load cell is also zeroed ("balances") and the upper platen is raised to a height of about 0.2 inch to allow sample insertion between the compression platens. Control of the Instron is then transferred to the computer. The extensionometer and load cell should be periodically checked to prevent baseline drift (shirting of the zero points). Measurements must be performed in a controlled humidity and temperature environment, according to TAPPI specifications (50%±2% RH and 73° F.).

Using the Instron Series XII Cyclic Test software (version 1.11), an instrument sequence is established. The programmed sequence is stored as a parameter file. The parameter file has 7 "markers" (discrete events) composed of three "cyclic blocks" (instructions sets) as follows:

Marker 1: Block 1

Marker 2: Block 2

Marker 3: Block 3

Marker 4: Block 2

Marker 5: Block 3

Marker 6: Block 1

Marker 7: Block 3.

Block 1 instructs the crosshead to descend at 0.75 in/min until a load of 0.1 lb is applied (the Instron setting is −0.1 lb, since compression is defined as negative force). Control is by displacement. When the targeted load is reached, the applied load is reduced to zero.

Block 2 directs that the crosshead range from an applied load of 0.05 lb to a peak of 8 lb then back to 0.05 lb at a speed of 0.2 in/min. Using the Instron software, the control mode is displacement, the limit type is load, the first level is −0.05 lb, the second level is −8 lb, the dwell time is 0 sec., and the number of transitions is 2 (compression then relaxation); "no action" is specified for the end of the block.

Block 3 uses displacement control and the displacement limit type to simply raise the crosshead to 0.15 inch at a speed of 4 in/min, with 0 dwell time. Other Instron software settings are 0 inches first level, 0.15 inches second level, 1 transition, and "no action" at the end of the block. If a sample has an uncompressed thickness greater than 0.15 inch, then Block 3 should be modified to raise the crosshead level to an appropriate height, and the altered level should be recorded and noted.

When executed in the order given above (Markers 1–7), the Instron sequence compresses the sample to 0.025 psi (0.1 lbf), relaxes, then compresses to 2 psi (8 lbf), followed by decompression and a crosshead rise to 0.15 in, then compresses the sample again to 2 psi, relaxes, lifts the crosshead to 0.15 in, compresses again to 0.025 psi (0.1 lbf), and then raises the crosshead. Data logging should be performed at intervals no greater than every 0.004 inch or 0.03 lbf (whichever comes first) for Block 2 and for intervals no greater than 0.003 lbf for Block 1. Once the test is initiated, slightly less than two minutes elapse until the end of the Instron sequence.

The output of the Series XII software is set to provide extension (thickness) at peak loads for Markers 1,2,4, and 6 (at each 0.025 and 2.0 psi peak load), the loading energy for Markers 2 and 4 (the two compressions to 2.0 psi), the ratio of the two loading energies (second 2 psi cycle/first 2 psi cycle), and the ratio of final thickness to initial thickness (ratio of thickness at last to first 0.025 psi compression). Load versus thickness results are plotted on screen during execution of Blocks 1 and 2.

Following the Instron test, the sample is placed in a 105° C. convection oven for drying. When the sample is fully dry (after at least 20 minutes), the dry weight is recorded. (if a heated balance is not used, the sample weight must be taken within a few seconds of removal from the oven because moisture immediately begins to be absorbed by the sample.)

The utility of a web or absorbent structure having a high Wet Compressed Bulk (WCB) value is obvious, for a wet material which can maintain high bulk under compression can maintain higher fluid capacity and is less likely to allow fluid to be squeezed out when it is compressed.

High Springback values are especially desirable because a wet material that springs back after compression can maintain high pore volume for effective intake and distribution of subsequent insults of fluid, and such a material can regain fluid during its expansion which may have been expelled during compression. In diapers, for example, a wet region may be momentarily compressed by body motion or changes in body position. If the material is unable to regain its bulk when the compressive force is released, its effectiveness for handling fluid is reduced.

High Loading Energy Ratio values in a material are also useful, for such a material continues to resist compression (LER is based on a measure of the energy required to compress a sample) at loads less than the peak load of 2 psi, even after it has been heavily compressed once. Maintaining such wet elastic properties is believed to contribute to the feel of the material when used in absorbent articles, and may help maintain the fit of the absorbent article against the wearer's body, in addition to the general advantages accrued when a structure can maintain its pore volume when wet.

The webs of this invention can exhibit high wet resiliency values in terms of any of three parameters mentioned above. More specifically, the uncalendered or calendered webs of this invention can have a Wet Compressed Bulk of about 5 cubic centimeters per gram or greater, more specifically about 6 cubic centimeters per gram or greater, more specifically about 8 cubic centimeters per gram or greater, and still more specifically from about 8 to about 15 cubic centimeters per gram. The Compression Ratio can be about 0.7 or less, such as from about 0.4 to about 0.7, more specifically about 0.6 or less, and still more specifically about 0.5 or less. Also, webs of the present invention can have a Wet Springback Ratio of about 0.5 or greater, such as from about 0.5 to about 0.8, more specifically about 0.6 or greater, and more specifically about 0.7 or greater. The Loading Energy Ratio can be about 0.45 or greater, about 0.5 or greater, and more specifically from about 0.55 to about 0.8, and more specifically about 0.6 or greater.

DETAILED DESCRIPTION OF THE DRAWINGS

The invention will now be described in greater detail with reference to the Figures. For simplicity, the various tensioning rolls schematically used to define the several fabric runs are shown but not numbered, and similar elements in different Figures have been given the same reference numeral. A variety of conventional papermaking apparatuses and operations can be used with respect to the stock preparation, headbox, forming fabrics, web transfers and drying. Nevertheless, particular conventional components are illustrated for purposes of providing the context in which the various embodiments of the invention can be used.

The process of the present invention may be carried out on an apparatus as shown in FIG. 1. An embryonic paper web 10 formed as a slurry of papermaking fibers is deposited from a headbox 12 onto an endless loop of foraminous forming fabric 14. The consistency and flow rate of the slurry determines the dry web basis weight, which desirably is between about 5 and about 80 grams per square meter (gsm), and more desirably between about 10 and about 40 gsm.

The embryonic web 10 is partially dewatered by foils, suction boxes, and other devices known in the art (not shown) while carried on the forming fabric 14. For high speed operation of the present invention, conventional tissue dewatering methods prior to the dryer cylinder may give inadequate water removal, so additional dewatering means may be needed. In the illustrated embodiment, an air press 16 is used to noncompressively dewater the web 10. The illustrated air press 16 comprises an assembly of a pressurized air chamber 18 disposed above the web 10, a vacuum box 20 disposed beneath the forming fabric 14 in operable relation with the pressurized air chamber, and a support fabric 22. While passing through the air press 16, the wet web 10 is sandwiched between the forming fabric 14 and the support fabric 22 in order to facilitate sealing against the web without damaging the web. The air press provides substantial rates of water removal, enabling the web to achieve dryness levels well over 30 percent prior to attachment to the Yankee, desirably without the requirement for substantial compressive dewatering. Suitable air presses are disclosed in U.S. patent application Ser. No. 08/647,508 filed May 14, 1996 by M. A. Hermans et al. titled "Method and Apparatus for Making Soft Tissue" and U.S. patent application Ser. No. unknown filed on the same day as the present application by F. Hada et al. titled "Air Press For Dewatering A Wet Web."

Following the air press 16, the wet web 10 travels further with fabric 14 until it is transferred to a textured, foraminous fabric 24 with the assistance of a vacuum transfer shoe 26 at a transfer station. The transfer is desirably performed with rush transfer, using properly designed shoes, fabric positioning, and vacuum levels such as disclosed in U.S. Pat. No. 5,667,636 issued Sep. 16, 1997 to S. A. Engel et al. and U.S. Pat. No. 5,607,551 issued Mar. 4, 1997 to T. E. Farrington, Jr. et al. In rush transfer operation, the textured fabric 24 travels substantially more slowly than the forming fabric 14, with a velocity differential of at least 10 percent, particularly at least 20 percent, and more particularly between about 15 and about 60 percent. The rush transfer desirably provides microscopic debulking and increases machine direction stretch without unacceptably decreasing strength.

The textured fabric 24 may comprise a three-dimensional throughdrying fabric such as those disclosed in U.S. Pat. No. 5,429,686 issued Jul. 4, 1995 to K. F. Chiu et al., or may comprise other woven, textured webs or nonwoven fabrics. The textured fabric 24 may be treated with a fabric release agent such as a mixture of silicones or hydrocarbons to facilitate subsequent release of the wet web from the fabric. The fabric release agent can be sprayed on the textured fabric 24 prior to the pick-up of the web. Once on the textured fabric, the web 10 may be further molded against the fabric through application of vacuum pressure or light pressing (not shown), though the molding that occurs due to vacuum forces at the transfer shoe 26 during pick-up may be adequate to mold the sheet.

The wet web 10 on the textured fabric 24 is then pressed against a cylindrical dryer 30 by means of a pressure roll 32. The cylindrical dryer 30 is equipped with a vapor hood or Yankee dryer hood 34. The hood typically employs jets of heated air at temperatures above 300° F., particularly above 400° F., more particularly above 500° F., and most particularly above 700° F., which are directed toward the tissue web from nozzles or other flow devices such that the air jets have maximum or locally averaged velocities in the hood of at least one of the following levels: 10 m/s, 50 m/s, 100 m/s, or 250 m/s (meters per second).

Non-traditional hoods and impingement systems can be used as an alternative to or in addition to the Yankee dryer hood 34 to enhance drying of the tissue web. In particular, radial jet reattachment technology or radial slot reattachment technology may be used to decrease the degree of adhesion required for stable maintenance of the web 10 on the Yankee dryer 30. Radial jet and radial slot reattachment refers to a high efficiency heat transfer mechanism in which gaseous jets are directed approximately parallel to the surface being heated, creating intense recirculation zones above the surface which facilitate heat and mass transfer without imparting the high stresses or impingement forces of traditional drying technologies. Examples of radial jet reattachment technology are disclosed by E. W. Thiele et al. in "Enhancement of Drying Rate, Moisture Profiling and Sheet Stability on an Existing Paper Machine with RJR Blow Boxes," 1985 Papermakers Conference, Tappi Press, Atlanta, Ga., 1985, p. 223–228; and by R. H. Page et al., *Tappi J.,* 73(9): 229 (Sep. 1990); which are incorporated herein by reference. Additional cylindrical dryers or other drying means, particularly noncompressive drying, may be used after the first cylindrical dryer.

Though not shown, the web 10 may also be wrapped by the fabric 24 against the dryer surface for a predetermined span to improve drying and adhesion. The fabric desirably wraps the dryer for less than the full distance that the web is in contact with the dryer, and in particular the fabric separates from the web prior to the web entering the dryer hood 34.

The wet web 10 when affixed to the dryer 30 suitably has a fiber consistency of about 30 percent or greater, particularly about 35 percent or greater, such as between about 35 and about 50 percent, and more particularly about 38 percent or greater. The consistency of the web when it is initially attached to the cylindrical dryer can be below 60 percent, 50 percent, or 40 percent. The dryness of the web upon being removed from the dryer 30 is increased to about 60 percent or greater, particularly about 70 percent or greater, more particularly about 80 percent or greater, more particularly still about 90 percent or greater, and most particularly between 90 and 98 percent.

The resulting dried web 36 is drawn or conveyed from the dryer and removed without creping, after which it is reeled onto a roll 38. The term "without creping" includes both completely uncreped where the web does not contact a crepe blade at all and substantially uncreped where the web makes only incidental or minor contact with a crepe blade, meaning that the web is near the point of being releasable from the dryer surface by tension forces alone without the need for any creping. The web on the dryer surface is near the point of being releasable from the dryer surface without the need for any creping when a minor change in operating conditions permits removal from the dryer surface by tension alone without substantial damage to the web, as occurs by way of illustration when any of the following conditions allows successful detachment by tension forces alone: a) increasing the tension applied to pull the web off the dryer surface by no more than 10 percent, and more specifically by no more than 5 percent; b) increasing the amount of release agent applied per pound of fiber by no more than 10 percent, and more specifically by no more than 5 percent; c) decreasing the amount of adhesive compounds used in the process by no more than 10 percent, and more specifically by no more than 5 percent; or d) decreasing the strength of the adhesive bond of the web to the dryer surface by no more than 10 percent, and more specifically by no more than 5 percent. Webs of the present invention which are substantially uncreped will typically have a surface topography substantially absent of crepe folds (folds caused by creping on the dryer) greater than 20 microns in height and/or typically will not have a bulk gain of greater than about 10 percent, more specifically about 5 percent, due to minor creping action. The angle at which the web is pulled from the dryer surface is suitably about 80 to about 100 degrees, measured tangent to the dryer surface at the point of separation, although this may vary at different operating speeds.

Reeling may be done with any method known in the art, including the use of belt-driven winders or belt-assisted winders, as disclosed in U.S. Pat. No. 5,556,053 issued Sep. 17, 1996 to Henseler, which is incorporated herein by reference. The roll of tissue may then be calendered, slit, surface treated with emollient or softening agents, embossed, or the like in subsequent operations to produce the final product form.

For flexibility and for start up operations, a creping blade should be available to crepe the sheet off the cylinder dryer. The transition to uncreped operation, once an adequate balance of adhesive compounds and release agents have been applied, may be achieved by pulling the web sufficiently by the reel or other apparatus that the web detaches from the cylindrical dryer surface prior to contacting the crepe blade without significant damage to the web. The transition to uncreped operation involves increasing the release agents and/or decreasing the adhesive compounds in the interfacial control mixture sufficient to permit uncreped removal of the web, but not to the degree that the web becomes unstable in the dryer hood. Other factors that impact adhesion such as basis weight and pH should be monitored and controlled in optimizing the process.

If desired, the crepe blade may remain in place to clean the cylindrical dryer surface, but may be removed entirely or loaded relatively lightly after switching to uncreped mode.

Typical doctor blade loadings for creped operation are in the range of 15 to 30 pli (pounds of force per linear inch); light loading appropriate for cleaning the cylinder while operating in uncreped mode can be below 15 pli, particularly less than 10 pli, more particularly in the range of about 1 pli to about 10 pli and most particularly from about 1 pli to about 6 pli.

An interfacial control mixture 40 is illustrated being applied to the surface of the rotating cylinder dryer 30 in spray form from a spray boom 42 prior to the wet web 10 contacting the dryer surface. As an alternative to spraying directly on the dryer surface, the interfacial control mixture could be applied directly to either the wet web or the dryer surface by gravure printing or could be incorporated into the aqueous fibrous slurry in the wet end of the papermachine. Still alternatively, the adhesive compounds and release agents of the interfacial control mixture could be individually applied, either to the dryer surface or at different stages. In one particular embodiment, for example, the adhesive compounds are sprayed onto the dryer surface prior to application of the wet web and the release agent is added at the wet end to the fibrous slurry. While on the dryer surface, the web 10 may be further treated with chemicals, such as by printing or direct spray of solutions onto the drying web, including the addition of agents to promote release from the dryer surface.

Figure 2:
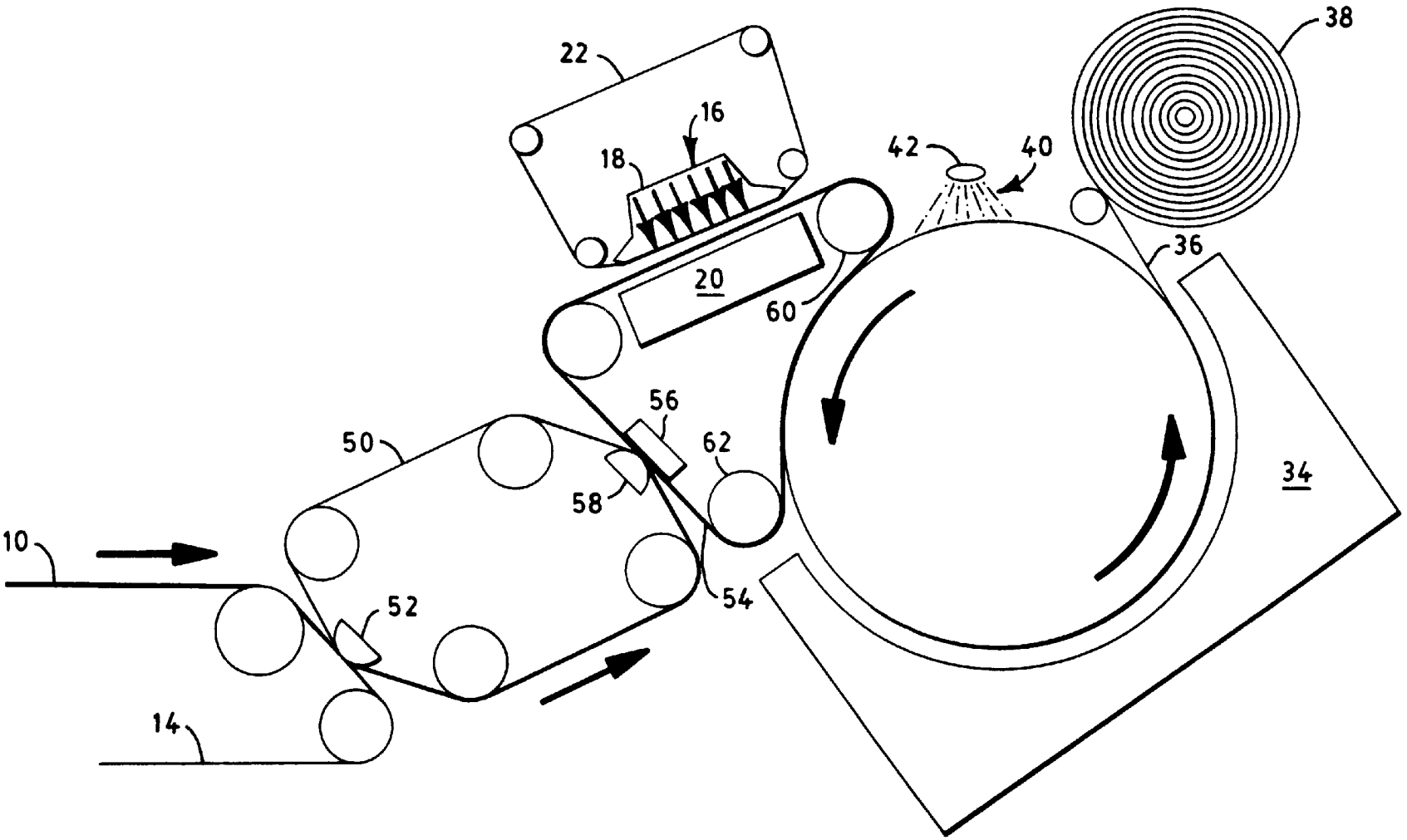
FIG. 2 depicts another schematic process flow diagram illustrating an alternative embodiment of the present invention, portraying a tissue machine with an additional web transfer and a degree of fabric wrap.

Another embodiment is shown in FIG. 2 where a wet web 10 is transferred from a forming fabric 14 to a first transfer fabric 50 by means of a transfer nip about a vacuum shoe 52. The web 10 is desirably rush transferred to the first transfer fabric 50, which may have a fabric coarseness greater, less than, or about the same as that of the forming fabric 14. For improved sheet texture, the first transfer fabric 50 desirably has a fabric coarseness at least 30 percent greater than that of the forming fabric, and more particularly at least 60 percent greater.

The wet web 10 is then transferred to a second transfer fabric 54 by means of a transfer nip optionally comprising a vacuum box 56 and a blow box or pressurized chamber 58 to assist with the transfer and with dewatering of the web. The second transfer fabric 54 desirably has a Surface Depth of at least 0.3 mm and a fabric coarseness at least 50 percent greater than that of the forming fabric, more particularly at least 100 percent greater, and even more particularly at least 200 percent greater, in order to impart texture and bulk to the sheet. The second transfer nip may also involve rush transfer.

Further dewatering of the web 10 may be achieved by an air press 16 comprising a pressurized chamber 18 and a vacuum box 20 to force air to flow through the web without substantial densification. A top support fabric 22 helps to sandwich the web and prevent friction between the web and the surface of the air press, thus allowing close tolerances to prevent leakage of air from the sides of the air press for energy efficient dewatering. Room temperature air, heated air, superheated steam, or mixtures of steam and air may be used as the gaseous medium in the air press.

The second transfer fabric 54 is desirably less coarse than the first transfer fabric 50 such that the first transfer fabric provides molding of the web and the second transfer fabric permits increased heat transfer during drying by virtue of a somewhat smoother topography. If only a small portion of the web 10 is in intimate contact with the dryer surface, heat transfer will be impeded. The second transfer fabric 54 may be wrapped against the Yankee dryer 30 for a finite run of desirably at least about 6 inches, such as between about 12 and about 40 inches, and more particularly at least about 18 inches along the machine direction on the cylindrical dryer surface. The length of fabric wrap may depend on the coarseness of the fabric. Either, both, or none of rolls 60 and 62 may be loaded against the cylindrical dryer surface to enhance drying, sheet molding, and development of adhesive bonds. The adhesive bonds must be adequate to resist the blowing forces in the Yankee hood 34 prior to reeling the uncreped web 36 off the cylindrical dryer surface.

An interfacial control mixture 40 is applied to the surface of the cylinder dryer 30 from a spray boom 42 just prior to attachment of the web 10. The resulting dried web 36 is removed from the dryer 30 without creping and reeled onto a roll 38.

Figure 3:
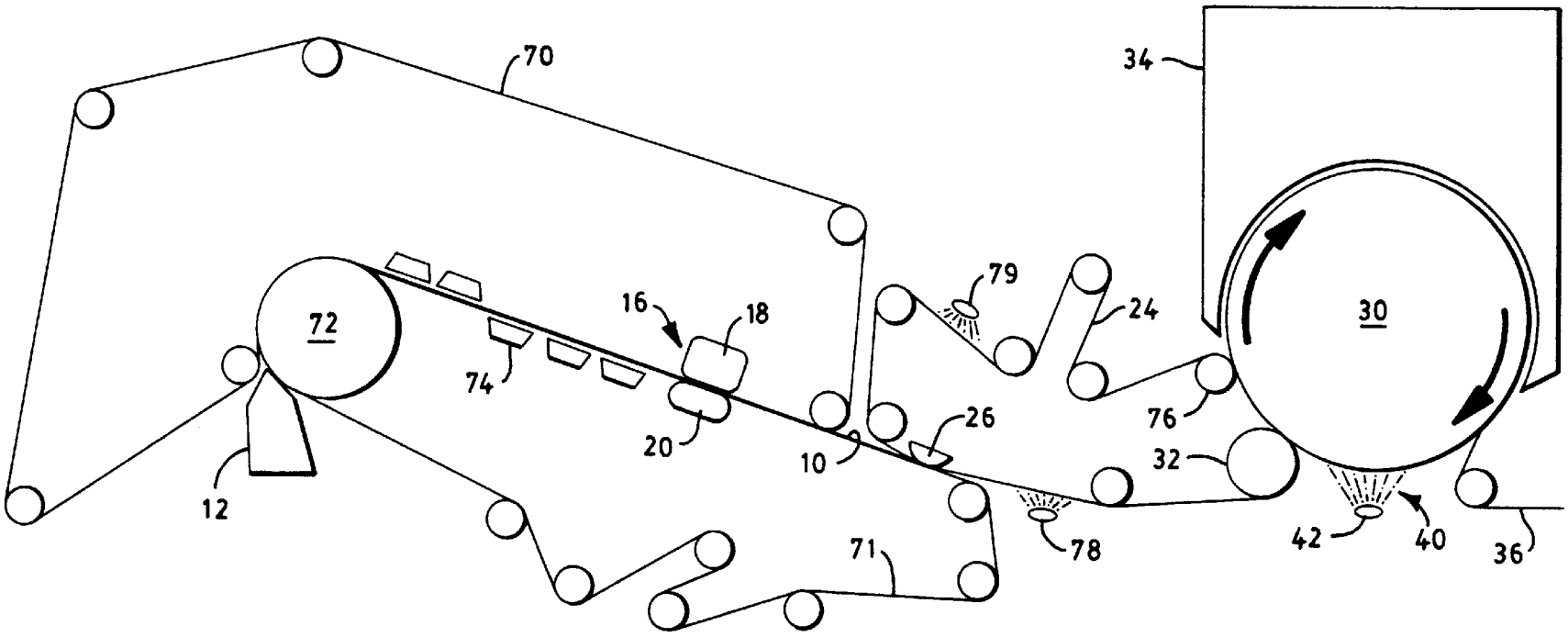
FIG. 3 depicts another schematic process flow diagram illustrating an embodiment of the invention involving a modified twin-wire machine according to the present invention.

Another embodiment of the invention is depicted in FIG. 3, where a slurry of papermaking fibers is deposited from a headbox 12 between top and bottom wires 70 and 71 of a twin-wire former. The two wires, which may be identical or of different patterns and materials, transport a web around a suction roll 72. The embryonic web is then dewatered by mechanical devices such as a series of vacuum boxes 74, foils, and/or other means. Desirably, the web is noncompressively dewatered to greater than 30 percent consistency using an air press 16 comprising a pressurized plenum 18 and a vacuum box 20. The dewatered web is then transferred, and particularly rush transferred, to a textured, foraminous fabric 24 at a transfer point assisted by a vacuum pickup shoe 26. In one particular embodiment, the textured fabric comprises a three-dimensional fabric such as a Lindsay Wire T-116-3 design (Lindsay Wire Division, Appleton Mills, Appleton, Wis.), having a fabric coarseness of at least 0.3 mm, which is desirably greater than that of the forming fabric.

The textured fabric 24 carries the web 10 into a nip between a roll 32 and a cylinder dryer 30, where the web is attached to the surface of the cylinder dryer. The textured fabric 24 may wrap the wet web on the cylinder dryer 30 for a short run of desirably less than 6 feet in the machine direction, more particularly less than 4 feet, comprising the span between the pressure roll 32 and a second roll 76 which may or may not be in contact with the cylinder dryer surface. The cylinder dryer surface is treated with adhesive compounds and/or release agents of an interfacial control mixture 40 by a spray applicator 42 or other application means prior to contacting the moist web. The surface of the web may additionally be sprayed with adhesive compounds, release agents or a mixture thereof by a spray shower 78 prior to attachment on the dryer surface. An additional spray boom or shower boom 79 may be used to apply a dilute release agent to the web-contacting side of the fabric 24 prior to receiving the web.

After the web is attached to the dryer surface, it may be further dried with a high-temperature air impingement hood 34 or other drying and impingement means. The partially dried web is then removed from the surface of the dryer 30, without creping, and the detached web 36 is then subjected to further drying (not shown), if needed, or other treatments before being reeled.

Figure 4:
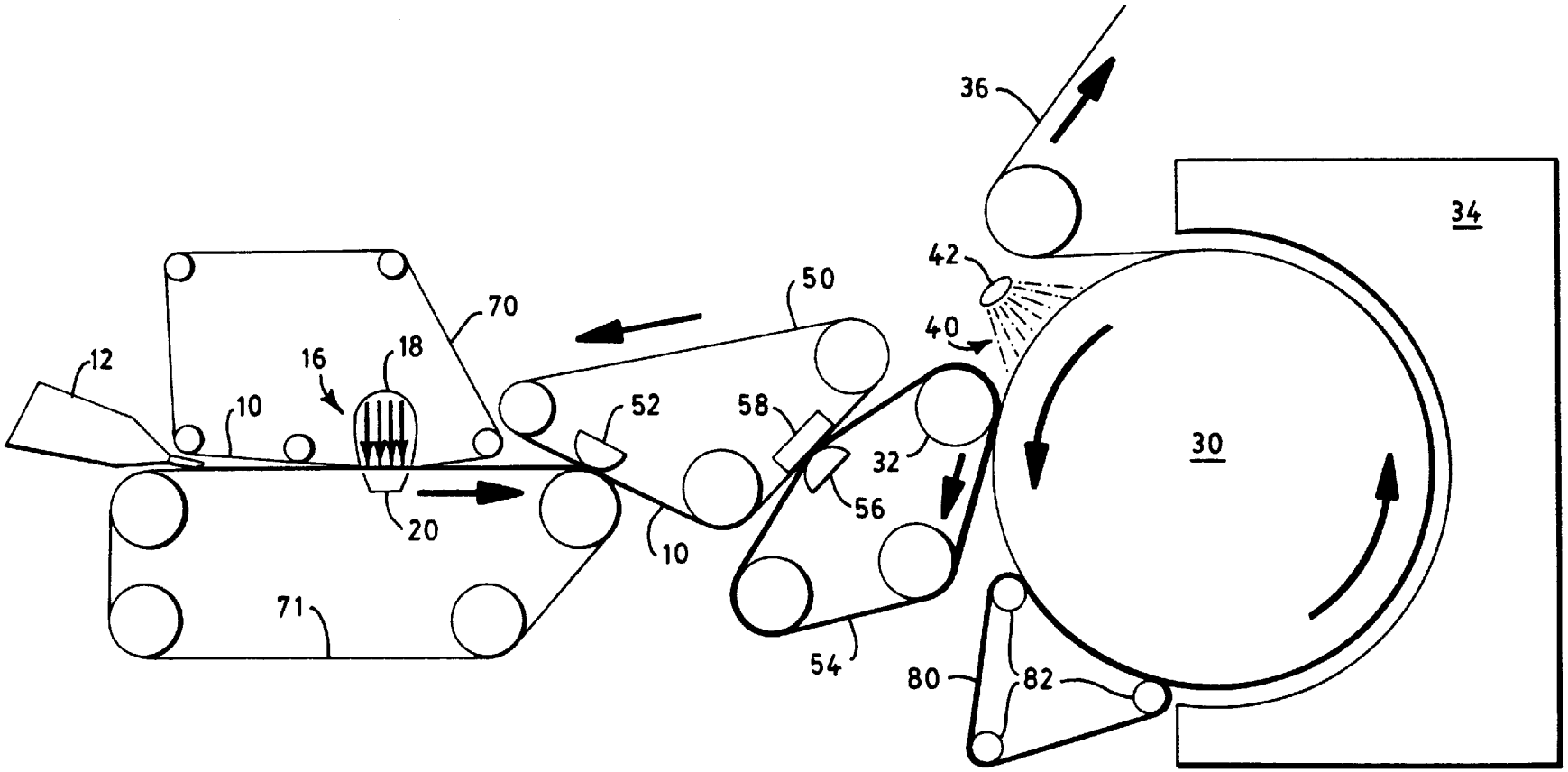
FIG. 4 depicts another schematic process flow diagram illustrating an alternative modified twin-wire machine useful for producing tissue according to the present invention.

Another embodiment is shown in FIG. 4 where an embryonic web 10 is deposited from a headbox 12 between a pair of wires 70 and 71 to permit dewatering by an air press 16 having a pressurized plenum 18 and a lower vacuum chamber 20. At a consistency of desirably about 30 percent solids or greater, the web 10 is transferred at a first transfer point to a first transfer fabric 50 with the assistance of a vacuum transfer shoe 52. The first transfer fabric 50 has substantially more void volume than the bottom wire 71 and desirably has a three-dimensional topography characterized by elevated machine-direction knuckles which rise above the highest cross-direction knuckles by at least 0.2 mm, particularly at least 0.5 mm, such as between about 0.8 and about 3 mm, and more particularly at least 1.0 mm.

The web 10 is transferred from the first transfer fabric 50 to a second transfer fabric 54 by means of a vacuum pickup shoe 56 and optionally a pressurized blow box or nozzle 58. Transfer to the first transfer fabric 50, the second transfer fabric 54, or to both, may be done with rush transfer of 10 percent or greater. The web on the second transfer fabric 54 is pressed against the surface of a cylindrical dryer 30 by a pressure roll 32. A short span of a contacting fabric 80 running between turning rolls 82 may engage the web on the cylindrical dryer surface to provide additional texturing or improved heat transfer. The web is then dried by convective means in a dryer hood 34 in addition to thermal conduction through the surface of the cylindrical dryer 30. An interfacial control mixture 40 or components thereof may be applied to the dryer surface using a spray boom 42. The dried web 36 is then removed without creping.

A degree of fabric wrap against the cylinder dryer surface may be desired to assist in heat transfer and to reduce sheet handling problems. If the fabric is removed too early, the sheet may stick to the fabric and not to the cylinder dryer surface unless the web is pressed at high pressure against the dryer surface, which is an undesirable solution when generally noncompressive treatment is desired for best bulk and wet resiliency. Desirably, the fabric remains in contact with the web on the dryer surface until the web has achieved a dryness level of about 40 percent or greater, particularly about 45 percent or greater, such as between about 45 and about 65 percent, more particularly about 50 percent or greater, and more particularly still about 55 percent or greater. The pressure applied to the web is desirably in the range of 0.1 to 5 psi, more particularly in the range of 0.5 to 4 psi, and more particularly still in the range of about 0.5 to 3 psi, though higher and lower values are still within the scope of the present invention. For embodiments involving significant fabric wrap, the degree of fabric wrap should be no more than 60 percent of the machine direction perimeter (circumference) of the cylindrical dryer, and particularly should be about 40 percent or less, more particularly about 30 percent or less, and most particularly between about 5 and about 20 percent of the circumference of the cylindrical dryer.

EXAMPLES

The following examples serve to illustrate possible approaches pertaining to the present invention. The particular amounts, proportions, compositions and parameters are meant to be exemplary, and are not intended to specifically limit the scope of the invention.

Example 1

Tissue was produced according to the present invention at a nominal basis weight of 12 lb/2880 $ft^2$ using an experimental tissue machine with a fabric width of 22 inches and an industrially useful speed of 1000 feet per minute at the Yankee dryer. The furnish comprised an unrefined 50:50 mix of bleached kraft eucalyptus fibers and bleached kraft southern softwood fibers (LL19 from the Coosa River pulp mill in Alabama). The fibrous slurry passed through a stratified, 3-layered headbox, with each stratum containing the same slurry to produce a blended sheet. Parez 631 NC strength aid was added to the slurry at a rate of 1000 ml/min at 6 percent solids. The slurry pH was maintained at 6.5 with a control system that employed addition of sulfuric acid and carbonate.

The headbox injected slurry between two forming fabrics in a twin wire forming section with a suction roll. Each fabric was a Lindsay Wire 2064 forming fabric. The embryonic web between the two fabrics was dewatered as it passed over five vacuum boxes operating with respective vacuum pressures of 10.8, 13.8, 13.4, 0, and 19.2 in Hg. After the vacuum boxes, the embryonic web, still contained between two forming fabrics, passed through an air press with a plenum pressure of 15 psig and a vacuum box pressure of 9 inches Hg vacuum. At a speed of 1000 fpm, the air press was able to bring the consistency of the web from 27.8 percent prior to the air press to 39.1 percent after the air press, a significant degree of dewatering.

The dewatered web was then transferred to a three-dimensional fabric normally used for molding of through-dried webs, a Lindsay Wire T-216-3 TAD fabric. The transfer to the TAD fabric involved a vacuum pickup shoe capable of effective rush transfer and was done with three different levels of rush: 10 percent, 20 percent, and 30 percent. The TAD fabric then approached the Yankee dryer and was pressed against the dryer surface with a conventional pressure roll. About 24 inches of fabric wrap along the Yankee dryer surface was enabled by the position of a secondary pressure roll which was unloaded and slightly removed from the Yankee dryer, similar to the configuration in FIG. 4. Prior to receiving the web, the TAD fabric was sprayed with a silicone release agent, a Dow Corning 2-1437 silicone emulsion having about 1 percent active solids, the emulsion being applied at a flow rate of about 400 ml/min to provide an applied silicone dose of roughly 20 to 25 $mg/m^2$. The silicone was applied to prevent the sheet from adhering to the TAD fabric rather than to the Yankee dryer surface. The silicone appeared to be useful in the process for at a point when the flow of silicone was interrupted, transfer of the web from the TAD fabric to the Yankee became problematic as the web stuck to the TAD fabric.

During startup, the tissue web running at a rush transfer of 10 percent was creped on a Yankee dryer operating at a steam pressure of about 70 psig, which was later increased to a peak value of about 100 psig. The hood operated at a temperature of about 650° F. to 750° F. during startup, with values in excess of 750° F. later achieved, and ran with an air recirculation value of about 35 to about 45 percent, which results in an air impingement velocity of about 65 meters per second. The sheet was dry creped at a consistency of about 95 percent. The Yankee coating comprised polyvinyl alcohol AIRVOL 523 made by Air Products and Chemical Inc. and sorbitol in water applied by four #6501 spray nozzles by Spraying Systems Company operating at approximately 40 psig with a flow rate of about 0.4 gallons per minute (gpm). The spray had a solids concentration of about 0.5 weight percent. Without removing or detaching the creping blade, the transition to uncreped operation was achieved by elevating the level of release agent applied to the web until the web lifted off the Yankee under the tension from the reel just before the creping blade. It was discovered that if excess release agent was applied to the Yankee surface, that the sheet could fail to adhere at all or could release prematurely and go up into the hood. With proper balancing of adhesive compound and release agent concentrations, however, successful and stable operation was possible.

A successful interfacial control mixture for this experiment comprised, on a percent active solids basis, approximately 26 percent polyvinyl alcohol, 46 percent sorbitol, and 28 percent of Hercules M1336 polyglycol applied at a dose of between 50 and 75 $mg/m^2$ . The compounds were prepared in an aqueous solution having less than 5 percent solids by weight. During creped production of the tissue, the amount of Hercules M1336 was gradually increased to the optimum level of about 28 percent to decrease the degree of creping and to eventually permit the web to be pulled off the Yankee dryer without creping. The web was pulled by the reel, which operated at essentially the same speed as the Yankee.

Subsequently, the degree of rush transfer was further increased. In increasing the rush to 20 percent and then to 30 percent, it was necessary to make several adjustments in operating conditions to obtain uncreped product successfully. A slight speed decrease from 1000 fpm to 900 fpm assisted in increasing the amount of rush transfer that could be successfully applied. Increasing sheet basis weight from 12 lbs/2880 $ft^2$ to 13 lbs/2880 $ft^2$ also proved helpful in permitting a higher degree of rush transfer.

Without wishing to be bound by theory, it is believed that differences in rush transfer result in differences in sheet topography that directly affect the nature of web adhesion on the Yankee dryer surface. As a result, an increase in rush transfer, with the concomitant expected increase in Surface Depth and texture of the web, is expected to provide a surface having less contact with the Yankee dryer. As a result, to maintain enough adhesion to prevent premature sheet release or fluttering during drying on the cylindrical dryer surface, an increase in rush transfer may require compensating measures such as a higher level of adhesion, a lower machine speed, a higher degree of pressing, a lower air recirculation rate in the hood to reduce aerodynamic forces, or a higher basis weight, which provides more mass and more resistance to blowing forces.

To facilitate release of the web from the TAD fabric, a silicone release agent was sprayed onto the TAD fabric prior to web pick-up at a rate of 400 ml/min of a solution having about 1 percent silicone solids.

Product made with 20 percent rush transfer was converted in rolls of toilet paper and tested for physical properties. The uncreped tissue with 20 percent rush transfer had a machine direction stretch of 13 percent, compared to the similar creped tissue without rush transfer which had a machine direction stretch of 14 percent. Both types of sheet had a bone-dry basis weight of 19 gsm. The caliper of 8 plies at 2 kPa pressure was measured at 2.4 mm for the uncreped web and 1.67 mm for the creped web. As a result, a roll of the uncreped tissue had a sheet count of 180 sheets compared to a sheet count of 253 sheets for a roll of creped tissue having the same diameter. The absorbent capacity of the creped web was 11.8 grams water per gram fiber compared to 14.1 grams water per gram fiber for the uncreped product.

Measurements of surface topography were made with a 38-mm CADEYES moiré interferometer. Using profiles extracted from 10 profile lines in the cross-machine direction of a height map, a median P10 value of 0.22 mm was obtained for the air side Surface Depth of the web. The Yankee dryer side of the web had a slightly lower Surface Depth value of 0.19 mm, obtained in the same manner. The characteristic unit cell of the textured pattern on the web was largely rectilinear with a machine direction unit cell length of about 5.4 and a cross machine direction width of about 2.6 mm (the lateral length scale in this case). In appearance, the uncreped sheet was much the same as an uncreped through-dried sheet made with the same TAD fabric and furnish.

During the run, it was found that air recirculation rate in the hood affected the chemistry that needed to be applied to the Yankee, for higher recirculation rates result in higher aerodynamic forces on the web and necessitate stronger adhesion. For a proper control system to produce uncreped tissue on a Yankee dryer, the balance of agents in the interfacial control mixture must be responsive to the recirculation rate in the hood and other aerodynamic factors, in addition to being responsive to basis weight, wet end chemistry, degree of rush transfer, and other such factors.

The uncalendered Yankee-dried uncreped sheet, after standard converting into a roll of two-ply bath tissue, had higher bulk and absorbency than a similar uncreped through-dried sheet (the latter having an 8-ply caliper at 2 kPa of 1.5 mm and an absorbency of 12.5 grams water per gram fiber), but did not feel as soft. Further calendering or other mechanical treatment of the web (brushing, microstraining, recreping, or the like) could be used to increase softness while possibly surrendering some of the bulk or absorbency; chemical softening agents could also be applied, as is known in the art. The use of curled or dispersed fibers could also be instrumental in further increasing the softness of the web to achieve desired tactile properties in addition to the outstanding mechanical properties of the web.

The converted bath tissue made from the uncreped product of this Example had a machine direction strength of 1911 g/3 in and a CD strength of 1408 g/3 in. The wet cross direction strength was 105 g/3 in. The converted uncreped tissue had the following wet resiliency parameters: a Springback of 0.640, an LER of 0.591, and a Wet Compressed Bulk of 6.440, based on an average of 5 samples, with each sample comprising a stack of three two-ply sections of tissue. The respective standard deviations of the three wet resiliency parameters were 0.013, 0.014, and 0.131. The initial bulk of the moistened samples at the first compression of 0.025 psi was 20.1 cc/g. When the same three-dimensional tissue was attached to the Yankee surface with conventional adhesives and removed by conventional creping, the resulting wet resiliency parameters were relatively lower. The creped tissue had a Springback of 0.513, an LER of 0.568, and a Wet Compressed Bulk of 4.670, based on an average of 6 samples, with each sample again comprising a stack of three two-ply sections of tissue. The respective standard deviations of the three wet resiliency parameters were 0.022, 0.020, and 0.111. The average oven-dry basis weight of the uncreped samples was 37.3 gsm, and for the creped samples was 36.0 gsm.

Example 2

An uncreped tissue with high yield fibers and permanent wet strength agents was made substantially according to Example 1, but using a less textured Asten 44GST fabric in place of the Lindsay Wire TAD fabric as the transfer fabric. The furnish comprised 100 BCTMP softwood (spruce) fibers with 20 pounds per ton of fiber of KYMENE 557 LX (manufactured by Hercules, Wilmington, Del.) wet strength resin added in the fiber slurry. The tissue was attached to the Yankee drier at a consistency of about 34 percent and then dried to completion. An interfacial control mixture of polyvinyl alcohol, sorbitol, and Hercules M1336 polyglycol was again used, with dose and proportions of the agents adjusted for effective drying and detachment. The dried, uncreped tissue was removed from the Yankee and reeled without further processing. The oven-dry basis weight was 30.7 gsm.

The uncreped tissue had a Springback of 0.783, an LER of 0.743, and a Wet Compressed Bulk of 8.115, based on an average of 4 samples, with each sample comprising a stack of four single-ply sections of the tissue. The respective standard deviations of the three wet resiliency parameters were 0.008, 0.019, and 0.110. The initial bulk of the moistened sample at a load of 0.025 psi was 17.4 cc/g.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Further, various alternative process and equipment arrangements may be employed, particularly with respect to the stock preparation, headbox, forming fabrics, web transfers and drying, or as disclosed in U.S. patent application Ser. No. unknown filed on the same day as the present application by M. Hermans et al. and titled "Method For Making Tissue Sheets On A Modified Conventional Wet-Pressed Machine"; U.S. patent application Ser. No. unknown filed on the same day as the present application by M. Hermans et al. and titled "Method For Making Low-Density Tissue With Reduced Energy Input"; and U.S. patent application Ser. No. unknown filed on the same day as the present application by S. Chen et al. and titled "Low Density Resilient Webs And Methods Of Making Such Webs"; which are incorporated herein by reference. Therefore, the invention should not be limited by the specific embodiments described, but only by the claims and all equivalents thereto.

We claim:

1. A method for producing an uncreped tissue web comprising the steps of:

a) depositing an aqueous suspension of papermaking fibers onto a forming fabric to form an embryonic web;

b) noncompressively dewatering said embryonic web to a consistency of about 30 percent or greater;

c) texturing said web against a three-dimensional substrate to form a three-dimensional high bulk structure;

d) transferring said three-dimensional high bulk structure to a surface of a cylindrical dryer;

e) applying an interfacial control mixture which includes adhesive compounds and release agents to said surface of said cylindrical dryer, said interfacial control mixture adapted to adhere said three-dimensional high bulk structure to said surface of said cylindrical dryer without fluttering and permitting detachment of said three-dimensional high bulk structure without significant damage;

f) drying said three-dimensional high bulk structure on said cylindrical dryer; and g) detaching said three-dimensional high bulk structure from said surface of said cylindrical dryer without creping.

2. The method of claim 1 wherein said three-dimensional high bulk structure is pressed against said surface of said cylindrical dryer while said three-dimensional high bulk structure is in contact with a textured substrate.

3. The method of claim 1 wherein said three-dimensional high bulk structure is pressed onto said surface of said cylindrical dryer at a consistency of from between about 30 to about 45 percent while said three-dimensional high bulk structure is in contact with a textured substrate.

4. The method of claim 1 wherein said adhesive compounds are applied to said surface of said cylindrical dryer and said release agents are applied to said aqueous suspension of papermaking fibers.

5. The method of claim 1 wherein both said adhesive compounds and said release agents are applied to said surface of said cylindrical dryer.

6. The method of claim 1 wherein said adhesive compounds are water soluble.

7. The method of claim 6 wherein said adhesive compounds remain water soluble after a thin coating of said adhesive compounds in aqueous solution has been dried and heated at 150° C. for 30 minutes.

8. The method of claim 6 wherein said adhesive compounds in said interfacial control mixture are at least 90 percent water-soluble after being dried and heated to 250° F. for 30 minutes.

9. The method of claim 1 wherein said interfacial control mixture is substantially free of crosslinking agents.

10. The method of claim 1 wherein said interfacial control mixture is applied at a dose of about 0.02 to 0.15 grams of solid per square meter of application area.

11. The method of claim 1 wherein said interfacial control mixture comprises an effective amount of a polyol.

12. The method of claim 9 wherein said release agents include a hydrocarbon emulsion.

13. The method of claim 1 wherein said interfacial control mixture comprises greater than 0 to 80 percent sorbitol on a dry solids basis.

14. The method of claim 1 wherein said interfacial control mixture comprises polyvinyl alcohol.

15. The method of claim 1 further comprising the step of wrapping a fabric against said three-dimensional high bulk structure as said three-dimensional high bulk structure contacts said surface of said cylindrical dryer, wherein the length of said fabric wrap is less than 60 percent of the circumference of said cylindrical dryer.

16. The method of claim 1 wherein the maximum pressure applied to said three-dimensional high bulk structure when transferred to said surface of said cylindrical dryer is less than 400 psi, measured across a one-inch square region encompassing the point of maximum pressure.

17. The method of claim 1 further comprising the step of rush transferring said web to a transfer fabric traveling at least 10 percent slower than the velocity of said web prior to said rush transfer.

18. The method of claim 17 wherein said transfer fabric has a fabric coarseness of at least 0.3 mm.

19. The method of claim 1 further comprising the step of spraying a fabric release agent on said three-dimensional substrate prior to texturing said web against said three-dimensional substrate.

20. The method of claim 1 wherein said web is dewatered to a consistency of about 30 percent or greater with non-thermal dewatering.

21. The method of claim 1 wherein said web is dewatered to a consistency of about 30 percent or greater using only noncompressive dewatering means.

22. The method of claim 21 wherein said web is dewatered to a consistency of about 30 percent or greater using an air press, said air press including a pressurized air chamber operatively associated with a vacuum box.

23. The method of claim 1 wherein dewatering of said web and drying of said three-dimensional high bulk structure is achieved without the use of a rotary throughdryer.

24. The method of claim 1 wherein drying said three-dimensional high bulk structure on said cylindrical dryer comprises heated air impingement drying in a hood.

25. The method of claim 24 wherein said air impingement drying comprises air jets directed at said three-dimensional high bulk structure having mean velocities of at least 10 m/s.

26. A method for producing an uncreped tissue web at industrially useful speeds, said method comprising the steps of:

a) depositing an aqueous suspension of papermaking fibers onto a forming fabric to form an embryonic web;

b) noncompressively dewatering said embryonic web to a consistency of about 30 percent or greater;

c) texturing said embryonic web to form a three-dimensional high bulk structure and transferring said three-dimensional high bulk structure to a first transfer fabric;

d) transferring said three-dimensional high bulk structure to a second transfer fabric;

e) transferring said three-dimensional high bulk structure to a surface of a cylindrical dryer;

f) applying an effective amount of an interfacial control mixture which includes adhesive compounds and release agents, said interfacial control mixture adapted to adhere said three-dimensional high bulk structure to said surface of said cylindrical dryer without fluttering and permitting detachment of said three-dimensional high bulk structure without significant damage;

g) drying said three-dimensional high bulk structure on said surface of said cylindrical dryer; and h) detaching said three-dimensional high bulk structure from said surface of said cylindrical dryer without creping.

27. The method of claim 26 wherein said embryonic web is dewatered to a consistency of about 30 percent or greater after said web has been formed into a three-dimensional high bulk structure and has been transferred to one of said transfer fabrics.

28. The method of claim 27 wherein dewatering of said web and drying of said three-dimensional high bulk structure prior to detaching said three-dimensional high bulk structure from said surface of said cylindrical dryer is achieved without the use of a rotary throughdryer.

29. The method of claim 26 wherein said transfer of said three-dimensional high bulk structure from at least one of said transfer fabrics is achieved with at least 10 percent rush transfer.

30. The method of claim 29 wherein said first transfer fabric has a fabric coarseness at least 30 percent greater than that of said forming fabric.

31. A method for producing an uncreped tissue web comprising the steps of:

a) depositing an aqueous suspension of papermaking fibers onto a forming fabric to form an embryonic web;

b) noncompressively dewatering said embryonic web to a consistency of about 30 percent or greater;

c) texturing said web against a three-dimensional textured substrate to form a three-dimensional high bulk structure;

d) transferring said three-dimensional high bulk structure to a surface of a cylindrical dryer at a consistency of from between about 30 to about 45 percent using said textured substrate;

e) applying an interfacial control mixture which includes adhesive compounds and release agents, said adhesive compounds being water soluble and substantially free of crosslinking adhesive agents, said interfacial control mixture adapted to adhere said three-dimensional high bulk structure to said surface of said cylindrical dryer without fluttering and permitting detachment of said three-dimensional high bulk structure without significant damage;

f) drying said three-dimensional high bulk structure on said surface of said cylindrical dryer; and g) detaching said three-dimensional high bulk structure from said surface of said cylindrical dryer without creping.

32. The method of claim 31 wherein said adhesive compounds comprise sorbitol and polyvinyl alcohol.

33. The method of claim 31 wherein said adhesive compounds remain water soluble after a thin coating of said adhesive compounds in aqueous solution having a dry solids mass of 1 gram has been dried and heated at 150° C. for 30 minutes.

34. The method of claim 31 wherein said adhesive compounds in said interfacial control mixture are at least 90 percent water-soluble after being dried and heated to 250° F. for 30 minutes.

35. A method for producing an uncreped tissue web comprising the steps of:

a) depositing an aqueous suspension of papermaking fibers onto a forming fabric to form an embryonic web;

b) noncompressively dewatering said embryonic web;

c) texturing said web against a three-dimensional textured substrate to form a three-dimensional high bulk structure;

d) transferring said three-dimensional high bulk structure to a surface of a cylindrical dryer;

e) applying an interfacial control mixture which includes adhesive compounds and release agents, said interfacial control mixture adapted to adhere said three-dimensional high bulk structure to said surface of said cylindrical dryer without fluttering;

f) drying said three-dimensional high bulk structure on said surface of said cylindrical dryer;

g) detaching said three-dimensional high bulk structure from said surface of said cylindrical dryer using a creping blade;

h) adjusting said interfacial control mixture such that said interfacial control mixture is adapted to adhere said three-dimensional high bulk structure to said surface of said cylindrical dryer without fluttering and permitting detachment of said three-dimensional high bulk structure without significant damage; and i) detaching said three-dimensional high bulk structure from said surface of said cylindrical dryer without creping.

36. The method of claim 35 wherein said interfacial control mixture is adjusted by decreasing the amount of said adhesive compounds relative to the amount of said release agents.

37. The method of claim 35 wherein said three-dimensional high bulk structure is pressed onto said surface of said cylindrical dryer at a consistency of from between about 30 to about 45 percent while said three-dimensional high bulk structure is in contact with said textured substrate.

38. The method of claim 35 wherein said three-dimensional high bulk structure is detached from said surface of said cylindrical dryer without creping by increasing the speed of a reel onto which said three-dimensional high bulk structure is wound.

39. The method of claim 1 wherein said release agents are applied to a surface of said three-dimensional high bulk structure and said adhesive compounds are applied to said aqueous suspension of papermaking fibers.

40. The method of claim 1 wherein said release agents are applied to a surface of said three-dimensional high bulk structure and said adhesive compounds are applied to said surface of said cylindrical dryer.

41. The method of claim 1 wherein at least one of said adhesive compounds and said release agents are applied to the surface of said three-dimensional high bulk structure that contacts said cylindrical dryer prior to transferring said three-dimensional high bulk structure to said surface of said cylindrical dryer.

* * * * *

UNITED STATES PATENT AND TRADEMARK OFFICE

CERTIFICATE OF CORRECTION

PATENT NO. : 6,187,137 B1
DATED : February 13, 2001
INVENTOR(S) : Druecke et al.

It is certified that error appears in the above-identified patent and that said Letters Patent is hereby corrected as shown below:

Title page,
Under FOREIGN PATENT DOCUMENTS:
After 2 152 961 add -- A --.
After 2 179 949 add -- A --.
After 2 179 953 add -- A --.
After 2 235 754 add -- A--.
After 2 254 288 add -- B --.

Column 13,
Line 60, delete "1/2" and substitute -- 1/4 -- therefor.

Column 14,
Line 36, delete "dewaterinq" and substitute -- dewatering -- therefor.

Signed and Sealed this

Twenty-ninth Day of January, 2002

*Attest:*

*Attesting Officer*

JAMES E. ROGAN
*Director of the United States Patent and Trademark Office*